US009163304B2

(12) United States Patent
Bush et al.

(10) Patent No.: US 9,163,304 B2
(45) Date of Patent: Oct. 20, 2015

(54) HIGH STRENGTH FORGED ALUMINUM ALLOY PRODUCTS

(75) Inventors: Dustin M. Bush, Bay Village, OH (US); Edward L. Colvin, Newport, VA (US); Roberto J. Rioja, Murrysville, PA (US); Ralph R. Sawtell, Gibsonia, PA (US)

(73) Assignee: Alcoa Inc., Pittsburgh, PA (US)

( * ) Notice: Subject to any disclaimer, the term of this patent is extended or adjusted under 35 U.S.C. 154(b) by 775 days.

(21) Appl. No.: 12/799,244

(22) Filed: Apr. 20, 2010

(65) Prior Publication Data

US 2011/0253266 A1 Oct. 20, 2011

(51) Int. Cl.

| | |
|---|---|
| ***C22F 1/053*** | (2006.01) |
| ***C22F 1/04*** | (2006.01) |
| ***C22C 21/10*** | (2006.01) |

(52) U.S. Cl.

CPC . *C22F 1/04* (2013.01); *C22C 21/10* (2013.01); *C22F 1/053* (2013.01)

(58) Field of Classification Search

IPC ..... C22F 1/057,1/053, 1/04, 1/05; C22C 21/10

See application file for complete search history.

(56) References Cited

U.S. PATENT DOCUMENTS

| | | | | | |
|---|---|---|---|---|---|
| 3,333,990 | A | | 8/1967 | Brown et al. | 148/417 |
| 3,791,876 | A | * | 2/1974 | Kroger | 148/549 |
| 4,431,467 | A | | 2/1984 | Staley et al. | 148/701 |
| 4,693,747 | A | | 9/1987 | Bretz et al. | 75/249 |
| 4,790,884 | A | | 12/1988 | Young et al. | 148/535 |
| 4,861,391 | A | | 8/1989 | Rioja et al. | 148/564 |
| 4,863,528 | A | | 9/1989 | Brown et al. | 148/695 |
| 4,874,440 | A | | 10/1989 | Sawtell et al. | 148/437 |
| 4,927,469 | A | | 5/1990 | Rioja et al. | 148/514 |
| 4,946,517 | A | | 8/1990 | Cho | 148/693 |
| 4,954,188 | A | | 9/1990 | Ponchel et al. | 148/694 |
| 4,988,394 | A | | 1/1991 | Cho | 148/693 |
| 5,055,257 | A | | 10/1991 | Chakrabarti et al. | 148/564 |
| 5,108,519 | A | | 4/1992 | Armanie et al. | 148/689 |
| 5,151,136 | A | | 9/1992 | Witters et al. | 148/689 |
| 5,213,639 | A | | 5/1993 | Colvin et al. | 148/693 |
| 5,221,377 | A | * | 6/1993 | Hunt et al. | 148/417 |
| 5,277,719 | A | | 1/1994 | Kuhlman et al. | 148/694 |

(Continued)

FOREIGN PATENT DOCUMENTS

| | | |
|---|---|---|
| EP | 1522600 | 4/2005 |
| JP | 2001-335874 | 12/2001 |

(Continued)

OTHER PUBLICATIONS

Kervick, R., et al., "Enhancement of Aluminum Alloy Forgings through Rapid Billet Heating," pp. 1-62, Pub. No. ORNL/TM-2006/30, Oak Ridge National Laboratory for the U.S. Dept. of Energy, Jun. 2006.

(Continued)

*Primary Examiner* — Roy King
*Assistant Examiner* — Janelle Morillo
(74) *Attorney, Agent, or Firm* — Greenberg Traurig, LLP

(57) ABSTRACT

High strength forged aluminum alloys and methods for producing the same are disclosed. The forged aluminum alloy products may have grains having a high aspect ratio in at least two planes, generally the L-ST and the LT-ST planes. The forged aluminum alloy products may also have a high amount of texture. The forged products may realize increased strength relative to conventionally prepared forged products of comparable product form, composition and temper.

23 Claims, 20 Drawing Sheets
(15 of 20 Drawing Sheet(s) Filed in Color)

(56) References Cited

U.S. PATENT DOCUMENTS

| | | | | |
|---|---|---|---|---|
| 5,496,426 | A | 3/1996 | Murtha | 148/691 |
| 5,560,789 | A | 10/1996 | Sainfort et al. | 148/549 |
| 5,592,847 | A | 1/1997 | Sarkisian et al. | 72/356 |
| 5,850,755 | A | 12/1998 | Segal | 72/261 |
| 5,865,911 | A | 2/1999 | Miyasato et al. | 148/439 |
| 5,989,306 | A | 11/1999 | Rioja et al. | 75/338 |
| 6,027,582 | A * | 2/2000 | Shahani et al. | 148/417 |
| 6,048,415 | A | 4/2000 | Nakai et al. | 148/417 |
| 6,071,077 | A | 6/2000 | Rowlands | 416/223 A |
| 6,113,711 | A | 9/2000 | Armanie et al. | 148/689 |
| 6,134,779 | A | 10/2000 | Walker et al. | 29/888.092 |
| 6,315,842 | B1 | 11/2001 | Shahani et al. | 148/417 |
| 6,502,480 | B1 | 1/2003 | Walker et al. | 74/579 |
| 6,537,392 | B2 | 3/2003 | Magnusen et al. | 148/417 |
| 6,562,154 | B1 * | 5/2003 | Rioja et al. | 148/415 |
| 6,627,012 | B1 * | 9/2003 | Tack et al. | 148/690 |
| 6,790,407 | B2 | 9/2004 | Fridlyander et al. | 420/532 |
| 6,972,110 | B2 | 12/2005 | Chakrabarti et al. | 420/532 |
| 7,097,719 | B2 | 8/2006 | Bray et al. | 148/417 |
| 7,214,281 | B2 | 5/2007 | Gheorghe et al. | 148/550 |
| 7,438,772 | B2 * | 10/2008 | Rioja et al. | 148/417 |
| 7,452,429 | B2 | 11/2008 | Boselli et al. | 148/417 |
| 7,520,945 | B2 | 4/2009 | Dumont et al. | 148/417 |
| 2004/0060618 | A1 | 4/2004 | Benedictus et al. | 148/552 |
| 2004/0071586 | A1 | 4/2004 | Rioja et al. | 420/532 |
| 2004/0099352 | A1 | 5/2004 | Gheorghe et al. | 148/550 |
| 2005/0034794 | A1 | 2/2005 | Benedictus et al. | 148/552 |
| 2005/0039831 | A1 | 2/2005 | Sawtell et al. | 148/694 |
| 2005/0150578 | A1 | 7/2005 | Bes et al. | 148/439 |
| 2005/0189044 | A1 | 9/2005 | Benedictus et al. | 148/552 |
| 2005/0241735 | A1 | 11/2005 | Garratt et al. | 148/415 |
| 2005/0269000 | A1 | 12/2005 | Denzer et al. | 148/701 |
| 2006/0151075 | A1 | 7/2006 | Van Der Veen et al. | 148/694 |
| 2006/0157172 | A1 | 7/2006 | Fischer et al. | 148/690 |
| 2006/0174980 | A1 | 8/2006 | Benedictus et al. | 148/552 |
| 2006/0182650 | A1 | 8/2006 | Eberl et al. | 420/532 |
| 2006/0191609 | A1 | 8/2006 | Dangerfield et al. | 148/552 |
| 2006/0213591 | A1 | 9/2006 | Brooks et al. | 148/551 |
| 2007/0151636 | A1 | 7/2007 | Buerger et al. | 148/552 |
| 2008/0173377 | A1 | 7/2008 | Khosla et al. | 148/550 |
| 2008/0173378 | A1 | 7/2008 | Khosla et al. | 148/550 |
| 2008/0264644 | A1 | 10/2008 | Sawtell | 166/350 |
| 2009/0084474 | A1 | 4/2009 | Cheong et al. | 148/693 |
| 2009/0180920 | A1 | 7/2009 | Reichlinger et al. | 420/532 |
| 2010/0059151 | A1 * | 3/2010 | Iwamura et al. | 148/690 |
| 2010/0089503 | A1 * | 4/2010 | Inagaki et al. | 148/550 |

FOREIGN PATENT DOCUMENTS

| | | |
|---|---|---|
| JP | 2008-240076 | 10/2008 |
| WO | WO95/04837 | 2/1995 |
| WO | WO 2008114680 A1 * | 9/2008 |
| WO | WO 2008/156532 | 12/2008 |

OTHER PUBLICATIONS

Rohde, K. A., et al., "Alloy 7055-T7XXX Forgings," Datasheet, Alcoa Forged Products, May 15, 1995.

The Aluminum Association, International Alloy Designations and Chemical Composition Limits for Wrought Aluminum and Wrought Aluminum Alloys, Teal Sheets, pp. 1-28, revised Feb. 2009.

Automotive Aluminum / Aluminum Forge Stock, Extruded Forging Stock, retrieved online at http//www.kaiseraluminum.com/customers/products/forge-stock/, on Mar. 11, 2010.

Metallic Materials and Elements for Aerospace Vehicle Structures, Department of Defense Handbook MIL-HDBK-5J, pp. 3-363 to 3-367, Jan. 31, 2003.

McDarmaid, D. S. et al., "Effect of natural aging on the tensile properties of the Al Li alloys 8090, 8091 and 2091", *Materials Science Engineering*, Elsevier Sequoia, Lausanne, CH, vol. 101, pp. 193-200, May 1988.

Romlos M. et al., "Design of multistep aging treatment of 2009 (C458) Al—Li Alloy", *Journal of Materials Engineering and Performance*, ASM International, Materials Park, OH, US, vol. 14:5, pp. 641-646, Oct. 2005.

* cited by examiner

HIGH STRENGTH FORGED ALUMINUM ALLOY PRODUCTS

BACKGROUND

Forged aluminum alloy products may have lower strength than similar wrought products, which may be reflected in industry specifications. For example, the 7055-T74X allowable properties for extruded products are much higher than the typical 7055-T74X properties for forged products, as illustrated in Table 1, below. While the transverse strength properties are similar, the extruded product realizes about 10 ksi higher strength in the longitudinal direction. When once takes into account that allowable properties (i.e., guaranteed minimums) are generally much lower than typical properties, the difference between the below extruded and forged properties is even more pronounced.

TABLE 1

½" to 1" Thick Heat Treat Section Tensile Properties for 7055-T74X Extrusions and Forgings

| Property | 7055-T74XXX Extrusions (A-Basis) | 7055-T74 Forgings (Typical) |
|---|---|---|
| Longitudinal Yield Strength (ksi) | 78 | 68 |
| Longitudinal Ultimate Tensile Strength (ksi) | 85 | 76 |
| Longitudinal Transverse Yield Strength (ksi) | 74 | 72 |
| Longitudinal Transverse Ultimate Tensile Strength (ksi) | 80 | 79 |

SUMMARY OF THE DISCLOSURE

Broadly, the present disclosure relates to new forged aluminum alloy products, and methods for producing such products. Generally, the new forged aluminum alloy products achieve high strength, especially in the longitudinal direction. This increase in strength may be attributable to the unique microstructure of the new forged aluminum alloy products, as described in further detail below.

In one aspect, the forged aluminum alloy product comprises a crystalline microstructure made up of grains. The grains include first type grains and second type grains, as defined in further detail below. The forged product comprises from about 5 vol. % to about 50 vol. % of the first type grains, and the first type grains at least include representative first grains. The representative first grains have an average aspect ratio of at least about 3.5:1 in the LT-ST plane. In some embodiments, the representative first grains have an average aspect ratio of at least about 5:1 in the L-ST plane. It is believed that the high aspect ratio of such grains at least partially contributes to the high strength of the new forged products.

In one embodiment, the forged product includes at least about 7 vol. % first type grains (defined below). In other embodiments, the forged product includes at least about 10 vol. %, or at least about 12.5 vol. %, or at least about 15 vol. %, or at least about 17.5 vol. %, or at least about 20 vol. % first type grains. In one embodiment, the forged product includes not greater than about 45 vol. % first type grains. In other embodiments, the forged product includes at not greater than about 40 vol. %, or not greater than about 35 vol. %, or not greater than about 32.5 vol. % first type grains. In one embodiment, the forged product includes from about 20 vol. % to about 32.5 vol. % first type grains.

In one embodiment, the representative first grains (defined below) have an average aspect ratio of at least about 3.75:1 in the LT-ST plane. In other embodiments, the representative first grains have an average aspect ratio of at least about 4:1, or at least about 4.25:1, or at least about 4.5:1, or at least about 4.75:1, or at least about 5:1, or at least about 5.25:1, or at least about 5.5:1, or at least about 5.75:1, or at least about 6:1, or more, in the LT-ST plane. In one embodiment, the representative first grains have an average aspect ratio of not greater than about 20:1 in the LT-ST plane.

In one embodiment, the representative first grains have an average aspect ratio of at least about 5:1 in the L-ST plane. In other embodiments, the representative first grains have an average aspect ratio of at least about 6:1, or at least about 7:1, or at least about 8:1, or at least about 9:1, or at least about 10:1, or at least about 11:1, or at least about 12:1, or at least about 13:1, or at least about 14:1, or more, in the L-ST plane. In one embodiment, the representative first grains have an average aspect ratio of not greater than about 30:1 in the L-ST plane.

In addition to the amount of, and the aspect ratio of, the first type grains, the forged product may have a high amount of texture. Texture means a preferred orientation of at least some of the grains of a crystalline structure. Using matchsticks as an analogy, consider a material composed of matchsticks. That material has a random (zero) texture if the matchsticks are included within the material in a completely random manner. However, if the heads of at least some of those matchsticks are aligned in that they all point the same direction, like a compass pointing north, then the material would have at least some texture due to the aligned matchsticks. The same principles apply with grains of a crystalline material.

Textured aluminum alloys have grains whose axes are not randomly distributed. The amount of texture of an aluminum alloy can be measured using orientation imaging microscopy (OIM). When the beam of a Scanning Electron Microscope (SEM) strikes a crystalline material mounted at an incline (e.g., around 70°), the electrons disperse beneath the surface, subsequently diffracting among the crystallographic planes. The diffracted beam produces a pattern composed of intersecting bands, termed electron backscatter patterns, or EBSPs. EBSPs can be used to determine the orientation of the crystal lattice with respect to some laboratory reference frame in a material of known crystal structure.

Since the images can vary based on various factors, measured texture intensities are generally normalized by calculating the amount of background intensity, or random intensity, and comparing that background intensity to the intensity of the textures of the image. Thus, the relative intensities of the obtained texture measurements are dimensionless quantities that can be compared to one another to determine the relative amount of the different textures within a polycrystalline material. For example, an OIM analysis may determine a background (random) intensity and use orientation distribution functions (ODFs) to produce ODF intensity values. These ODF intensity values may be representative of the amount of texture within a given aluminum alloy (or other polycrystalline material).

For the present application, ODF intensities are measured according to the OIM sample procedure (described below), or a substantially similar OIM procedure (x-ray diffraction is not used), where a series of ODF plots containing intensity (times random) representations may be created. One example of a series of ODF plots is illustrated in FIG. 4, which were obtained from a conventionally forged product made from Aluminum Association alloy 7085. These ODF plots contain maximum intensity ratings relative to a predetermined scale (right-side of FIG. 4). As illustrated in FIG. 4, the conventionally produced 7085 forged product contains relatively low ODF intensities, generally having a greenish color for any texture, and achieves a maximum ODF intensity of about 24.15 (times random). These results indicate that the conventional 7085 forged product contains some texture, but not a significant amount of texture.

The new forged aluminum alloy products generally have a high maximum ODF intensity, indicating a high amount of texture. It is believed that the high amount of texture in the new forged aluminum alloy products may contribute to its high strength. In one embodiment, the new forged aluminum alloy product has a maximum ODF intensity of at least about 30 (times random). In other embodiments, the new forged aluminum alloy product has a maximum ODF intensity of at least about 35, or at least about 40, or at least about 45, or at least about 50, or at least about 55, or at least about 60, or at least about 65, or at least about 67, or higher.

In one embodiment, the new forged aluminum alloy product realizes a maximum ODF intensity that is at least about 10% higher than a conventionally-forged aluminum alloy product of comparable product form, composition and temper (e.g., a maximum ODF intensity of 27.5 when the conventional product has a maximum ODF intensity of 25). In other embodiments, the new forged aluminum alloy product may realize a maximum ODF intensity that is at least about 20% higher, or at least about 30% higher, or at least about 40% higher, or at least about 50% higher, or at least about 60% higher, or at least about 70% higher, or at least about 80% higher, or at least about 90% higher, or at least about 100% higher, or at least about 110% higher, or at least about 120% higher, or at least about 130% higher, or at least about 140% higher, or at least about 150% higher, or at least about 160% higher, or at least about 170% higher, or at least about 180% higher, or at least about 190% higher, or at least about 200%, or at least about 210% higher, or at least about 220% higher, or at least about 230% higher, or at least about 240% higher, or at least about 250% higher, or at least about 260% higher, or at least about 270% higher, or at least about 280% higher, or more, than a conventionally-forged aluminum alloy product of comparable product form, composition and temper.

Texture may also be determined from pole figures. Pole figures are stereographic projections, with a specified orientation relative to a specimen that shows the variation of pole density with the pole orientation for a selected set of crystal planes, e.g., the (111) or (200) planes. With respect to the instant application, pole figures are calculated using the OIM sample procedure (described below), or a substantially similar OIM procedure (x-ray diffraction is not used).

One example of a pole figure is illustrated in FIG. 2, which is the (111) pole figure of the above-noted conventionally prepared 7085 forged product. The 7085 pole figure has a generally random distribution of intensity representations, and with a maximum intensity of about 6.1 (times random). There is no symmetry relative to the intensity representations. These results all indicate that the 7085 forged product contains some texture, but not a significant amount of texture.

The new forged aluminum alloy products may realize higher intensity representations and/or more symmetrical intensity representations in one or more pole figures relative to a conventionally-forged aluminum alloy product of comparable composition. For example, as illustrated in FIG. 7, a (111) pole figure, of a new forged product made from aluminum association alloy 7255 contains a plurality of high value intensity representations. These intensity representations are generally yellow, orange and/or red, and with a maximum intensity of about 20.1. These high value intensity representations are also generally symmetrical. These results indicate that the new forged products have a high amount of texture.

One or more of the above features may contribute to the high strength properties of the new forged product. In one embodiment, a new forged product realizes at least about 5% higher tensile yield strength in the longitudinal (L) direction relative to a conventionally-forged aluminum alloy product of comparable product form, composition and temper. In other embodiments, a new forged product realizes at least about 6% higher, or at least about 7% higher, or at least about 8% higher, or at least about 9% higher, or at least about 10% higher, or at least about 11% higher, or at least about 12% higher, or at least about 13% higher, or at least about 14% higher, or at least about 15% higher, or at least about 16% higher, or at least about 17% higher, or at least about 18% higher, or more, in the L direction relative to a conventionally-forged aluminum alloy product of comparable product form, composition and temper. The improved strength is generally achieved across the entire forged product.

In one embodiment, a new forged aluminum alloy product realizes at least about 5% higher tensile yield strength in the longitudinal transverse (LT) direction relative to a conventionally-forged aluminum alloy product of comparable product form, composition and temper. In other embodiments, a new forged product realizes at least about 5.5% higher, or at least about 6% higher, or at least about 6.5% higher, or at least about 7% higher, or at least about 7.5% higher, or at least about 8% higher, or more, in the LT direction relative to a conventionally-forged aluminum alloy product of comparable product form, composition and temper.

The new forged products also generally retain the majority of the strength of its predecessor extruded product. In this regard, the new forged products generally have a tensile strength that is not greater than about 10% less than the tensile strength of its predecessor extruded product (e.g., a tensile strength of not less than about 81 ksi when its predecessor extruded product had a tensile strength of 90 ksi). In one embodiment, the new forged product has a tensile strength that is not greater than about 9% less than the tensile strength of its predecessor extruded product. In other embodiments, the new forged product may have a tensile strength that is not greater than about 8% less than, or not greater than about 7% less than, or not greater than about 6% less than, or not greater than about 5% less than, or not greater than about 4% less than, or not greater than about 3% less than the tensile strength of its predecessor extruded product. In this regard, the new forged product generally has a tensile strength that is not greater than about 10 ksi less than its predecessor extruded product. In one embodiment, the new forged product has a tensile strength that is not greater than about 9 ksi less than its predecessor extruded product. In other embodiments, the new forged product may have a tensile strength that is not greater than about 8 ksi less than, or not greater than about 7 ksi less than, or not greater than about 6 ksi less than, or not greater than about 5 ksi less than, or not greater than about 4 ksi less than, or not greater than about 3 ksi less than, or not greater than about 2 ksi less than, or not greater than about 1 ksi less than its predecessor extruded product.

In one embodiment, the forged aluminum alloy product is a 7x55 Aluminum Association alloy, such as 7055, 7155, or 7255. In some of these embodiments, a 7x55 forged product may realize a longitudinal tensile yield strength of at least about 72 ksi. In other of these embodiments, a 7x55 forged product may realize a longitudinal tensile yield strength of at least about 73 ksi, or at least about 74 ksi, or at least about 75 ksi, or at least about 76 ksi, or at least about 77 ksi, or at least about 78 ksi, or at least about 79 ksi, or at least about 80 ksi, or at least about 81 ksi, or at least about 82 ksi, or at least about 83 ksi, or at least about 84 ksi, or at least about 85 ksi, or at least about 86 ksi, or at least about 87 ksi, or at least about 87 ksi, or at least about 89 ksi, or at least about 90 ksi, or at least about 91 ksi, or more, depending on temper.

In one embodiment, a 7x55 forged product may realize a long transverse (LT) tensile yield strength of at least about 76 ksi. In other of these embodiments, a 7x55 forged product may realize an LT tensile yield strength of at least about 77 ksi, or at least about 78 ksi, or at least about 79 ksi, or at least about 80 ksi, or at least about 82 ksi, or at least about 83 ksi, or at least about 84 ksi, or at least about 85 ksi, or at least about 86 ksi, or at least about 87 ksi, or at least about 88 ksi, or at least about 89 ksi, or more, depending on temper.

In one embodiment, the alloy of the forged product is a 2xxx+Li alloy. In some of these embodiments, a 2xxx+Li forged product realizes a longitudinal tensile yield strength of at least about 80 ksi, in other of these embodiments, a 2xxx+Li forged product may realize a longitudinal tensile yield strength of at least about 81 ksi, or at least about 82 ksi, or at least about 83 ksi, or at least about 84 ksi, or at least about 85 ksi, or at least about 86 ksi, or at least about 87 ksi, or at least about 88 ksi, or at least about 89 ksi, or at least about 90 ksi, or at least about 91 ksi, or at least about 92 ksi, or at least about 93 ksi, or at least about 94 ksi, or more.

In one embodiment, a 2xxx+Li forged product realize a long transverse (LT) tensile yield strength of at least about 77 ksi. In other of these embodiments, a 2xxx+Li forged product may realize a long transverse (LT) tensile yield strength of at least about 78 ksi, or at least about 79 ksi, or at least about 80 ksi, or at least about 81 ksi, or at least about 82 ksi, or at least about 83 ksi, or at least about 84 ksi, or more.

In one embodiment, the 2xxx+Li alloy includes 3.4-4.2 wt. % Cu, 0.9-1.4 wt. % Li, 0.3-0.7 wt. % Ag, 0.1-0.6 wt. % Mg, 0.2-0.8 wt. % Zn, and 0.1-0.6 wt. % Mn, the balance being aluminum, incidental elements, and impurities. Other 2xxx+Li alloys and 7xxx alloys are described below.

In addition to having a high strength, the new forged product may be corrosion resistant and/or tough. In one embodiment, a new forged product realizes a toughness that is at least equivalent to a conventionally forged product of comparable product form, composition and temper, but having high strength, as described above. In one embodiment, a new forged product realizes a corrosion resistance (e.g., SCC, exfoliation) that is at least equivalent to a conventionally forged product of comparable product form, composition and temper, but having high strength, as described above. In one embodiment, both equivalent corrosion resistance and toughness are realized, and with high strength.

The new forged products are generally produced from heat treatable aluminum alloys. In one embodiment, the aluminum alloy of the forged product is a 2xxx aluminum alloy. In one embodiment, the aluminum alloy of the forged product is a 7xxx aluminum alloy. In one embodiment, the aluminum alloy of the forged product is a 6xxx aluminum alloy.

The 2xxx aluminum alloys may be any of those alloys listed in the Teal Sheets by the Aluminum Association, with or without lithium and/or silver, such as 2524, or any other 2x24 alloys, as well as 2040, 2139, 2219, 2195, and 2050, among others. Particularly useful 2xxx alloys are anticipated to include those having 2-6 wt. % Cu and 0.1-1 wt. % Mg, optionally with up to 2 wt. % Li, up to 1 wt. % Mn, and up to 1 wt. % Ag.

The 7xxx aluminum alloys may be any of those alloys listed in the Teal Sheets by the Aluminum Association, such as 7085, 7x40, 7x55, 7x49, 7081, 7037, 7056, 7x75, and 7x50, among others. Particularly useful 7xxx alloys are anticipated to include those having 5.2-10 wt. % Zn, 1.4-2.6 wt. % Cu, and 1.3-2.7 wt. % Mg.

The 6xxx aluminum alloys may be any of those alloys listed in the Teal Sheets by the Aluminum Association, such as 6x13, 6x56, 6061, and 6x82, among others. Particularly useful 6xxx alloys are anticipated to include those having 0.6-1.3 wt. % Si, 0.6-1.2 wt. % Mg, up to 0.5 wt. % Fe, up to 1.1 wt. % Cu, up to 1.0 wt. % Mn, up to 0.35 wt. % Cr, up to 0.7 wt. % Zn, up to 0.15 wt. % Ti, and up to 0.2 wt. % Zr.

The heat treatable alloys may include incidental elements, such as grain structure control agents (e.g., Zr, Sc, Hf), grain refiners (e.g., Ti with or without B or C), and casting aids (e.g., Ca, Sr), among others. These incidental elements may be added in amounts from about 0.01 wt. % to about 1.0 wt. %, depending on alloy type and requisite properties, as known to those skilled in the art. The balance of the heat treatable aluminum alloy is generally aluminum and impurities.

Methods of producing high strength forgings are also provided, one embodiment of which is illustrated in FIG. 10. In the illustrated embodiment, the method (200) includes the steps of casting an aluminum alloy (210), extruding the aluminum alloy into an extruded product (220), and forging the extruded product into a forged product (240). As described in further detail below, the extruding step (220) may be carried out in a manner that facilitates production of the extruded product while restricting the amount of first type grains within the extruded product. The forging step (240) may be carried out in a manner that restricts the increase in the amount of first type grains within the forged product relative to the extruded product and/or in a manner that at least maintains, if not increases, the amount of texture within the forged product relative to the extruded product. In turn, high strength forged products may be realized.

Referring now to FIG. 11*a*, the casting step (210) generally comprises casting an aluminum alloy into ingot or billet form, such as by direct chill casting or similar methods. The casting (210) may include filtering (212) of the aluminum alloy and/or degassing (214) of the aluminum alloy. The filtering (212) may increase the cleanliness and/or purity of the cast aluminum alloy, and may be conducted with a single or dual stage filter, and with a pore size of 20 PPI or better. The degassing step (214) may reduce the amount of hydrogen in the aluminum alloy, such as via an inert gas box. The degassing step (214) should reduce the amount of hydrogen in the aluminum alloy to not greater than about 0.15 ppm, or, in some embodiments, to about 0.05 ppm. Such casting conditions may facilitate production of extruded products having a low amount of first type grains.

Prior to the extruding step (220), the aluminum alloy ingot or billet may be homogenized (216). This homogenization step (216) should be accomplished in such a manner so as to dissolve substantially all soluble constituent phases without creating melting reactions.

Referring now to FIG. 11*b*, the extruding step (220) is generally carried out in a manner to that restricts the amount of first type grains within the extruded product. In this regard, the extrusion step (220) is generally completed with an indirect extrusion process, but could be completed with a direct extrusion process. The extrusion ratio (222) is generally in the range of from about 3:1 to 100:1. In some embodiments, the extrusion ratio is at least about 7:1. In some embodiments, the extrusion ratio is not greater than about 50:1.

The extruding step (220) should generally be accomplished with accurate and precise temperature control. In this regard, induction heating (224) may be used, which allows for temperature control of +/−15° F., or better. The ram speed (226) may also be precisely regulated so as to achieve adiabatic heating of the metal. The ram speed (226) is generally related to both the extrusion ratio (222) and the heating (224) of the extrusion. The exit temperature (228) of the extruded product may be measured and the ram speed (226) controlled accordingly. A high exit temperature (228) should be utilized to facilitate production of extruded products having a low amount of first type grains. High exit temperatures (228) may also facilitate production of extruded products having a high amount of texture.

With carefully controlled extrusion conditions, extruded products having a low amount of first type grains and/or high texture may be produced. Furthermore, with the appropriate extrusion ratio, the first type grains may realize a high aspect ratio in the L-ST direction. In one embodiment, an extruded product contains not greater than about 40 vol. % of first type grains. In other embodiments, an extruded product contains not greater than about 35 vol. %, or not greater than about 30 vol. %, or not greater than about 25 vol. %, or not greater than about 20 vol. %, or not greater than about 17.5 vol. %, or not greater than about 15 vol. %, or less, of first type grains. With respect to texture, in one embodiment, an extruded product realizes a maximum ODF intensity of at least about 8. In other embodiments, the extruded product may realize a maximum ODF intensity of at least about 10, or at least about 12, or at least about 14, at least about 16, or at least about 18, or at least about 20, or higher.

The extruded product used for the forging step (240) is generally of a bar or a rod shape. The extruded product generally has a thickness and/or diameter of at least about 2 inches. In one embodiment, the extruded product has a thickness and/or diameter of at least about 2.5 inches. In other embodiments, the extruded product may have a thickness and/or diameter of at least about 3 inches, or at least about 3.5 inches, or at least about 4 inches, or at least about 4.5 inches, or at least about 5 inches, or more.

Referring now to FIG. 11*c*, the forging step (240) is generally completed after the extrusion step (220). The forging step (240) generally comprises hot working (242) of the extruded product to produce a forged product. The hot working (242) may be completed in one or multiple steps. The heat (244) and strain (246) applied to the extruded product during the hot working (242) should be controlled such that the forged product realizes a restricted increase in the amount of first type grains and/or such that the texture of the forged product is at least equivalent to that of the extruded product (i.e., the forged product realizes a forged maximum ODF intensity that is at least equivalent to the extruded maximum ODF intensity). In this regard, low strain rates and/or high temperatures (e.g., above the recrystallization temperature of the alloy) during hot working may be used. These strain rates and temperatures generally depend on the type of alloy being processed, as well as the type of forged product being produced. To facilitate the use of appropriate strain rates, a hydraulic press may be used. The hydraulic press should be capable of forging at a rate of from about 10 inches to about 30 inches per minute ram speed.

The temperature during the forging (240) should be precisely and accurately regulated (e.g., to +/−20° F.) to facilitate restricted production of first type grains. Additionally, the forging temperature should be maintained within close proximity to the incipient melting temperature of the alloy, but without reaching the incipient melting temperature. In one embodiment, the set point of the forging temperature is about 20° F. below the incipient melting temperature of the alloy, and the temperature is controlled to +/−20° F. In one embodiment, a forging step comprises forging the extruded product at a temperature that is not greater than 45° F. below the incipient melting temperature of the alloy at any point during the forging operation. In other embodiments, the forging temperature may be not greater than 44° F. below, or not greater than 43° F. below, or not greater than 42° F. below, or not greater than 41° F. below, or not greater than 40° F., or not greater than 39° F. below, or not greater than 38° F. below, or not greater than 37° F. below, or not greater than 36° F. below, or not greater than 35° F. below, or not greater than 34° F. below, or not greater than 33° F. below, or not greater than 32° F. below, or not greater than 31° F. below, or not greater than 30° F. below, or not greater than 29° F. below, or not greater than 28° F. below, or not greater than 27° F. below, or not greater than 26° F. below, or not greater than 25° F. below, or not greater than 24° F. below, or not greater than 23° F. below, or not greater than 22° F. below, or not greater than 21° F. below, or not greater than 20° F. below the incipient melting temperature of the alloy at any point during the forging operation.

Those skilled in the art will understand that these examples are only a few of the ways to achieve the inventive microstructure, and that it is possible to change the forging processing variables to be outside of this shape and still achieve the same inventive microstructure. The forging step (240) may include an optional anneal (248) after the hot working step (242).

The forging step (240) may result in the production of a forged product having a low amount of first type grains, such as in the range of 5 vol. % to 50 vol. %, as described above (e.g., after solution heat treating (250), described below). The forging step (240) may also result in a relatively small increase in the amount of first type grains in the forged product relative to its predecessor extruded product. In one embodiment, a forged product contains not greater than about 30 vol. % more first type grains than its predecessor extruded product (e.g., if an extruded product contained 17.5 vol. % of first type grains, the forged product would contain not more than 47.5 vol. % of first type grains). In other embodiments, a forged product contains not greater than about 25 vol. % more, or not greater than about 20 vol. % more, or not greater than about 18 vol. % more, or not greater than about 16 vol. % more, or not greater than about 14 vol. % more, or not greater than about 12 vol. % more, or not greater than about 10 vol. % more, or not greater than about 8 vol. % more first type grains than its predecessor extruded product. The forging step may also result in first type grains having the high aspect ratios in the L-ST and/or LT-ST planes, as described above.

The forging step (240) may result in the production of a forged product having a high amount of texture, such as having a maximum ODF intensity of at least about 30, as described above. The forging step (240) may also result in maintaining, if not increasing, the amount of texture in the forged product relative to its predecessor extruded product. For example, the forged product may realize a forged maximum ODF intensity, and its predecessor extruded product may realize an extruded maximum ODF intensity, each of which are measured separately; the extruded maximum ODF intensity being measured on the extruded product after it has been produced, and before it is turned into a forged product, and the forged maximum ODF intensity being measured on the forged product after it has been produced and after it has been solution heat treated, and optionally quenched and/or artificially aged.

The forging step (240) generally results in a forged maximum ODF intensity that is at least as high as the extruded maximum ODF intensity. In one embodiment, the forged maximum ODF intensity is at least 5% higher than that of the extruded maximum ODF intensity (e.g., a maximum ODF intensity of 25.2 if the extruded maximum ODF intensity is 24). In other embodiments, the forged maximum ODF intensity may be at least 10% higher, or at least about 20% higher, or at least about 30% higher, or at least about 40% higher, or at least about 50% higher, or at least about 60% higher, or at least about 70% higher, or at least about 80% higher, or at least about 90% higher, or at least about 100% higher, or at least about 110% higher, or at least about 120% higher, or at least about 130% higher, or at least about 140% higher, or at least about 150% higher, or at least about 160% higher, or at least about 170% higher, or at least about 180% higher, or at least about 190% higher, or at least about 200%, or at least about 210% higher, or at least about 220% higher, or at least about 230% higher, or at least about 240% higher, or at least about 250% higher, or at least about 260% higher, or at least about 270% higher, or at least about 280% higher, or more, than that of the extruded maximum ODF intensity.

The new forged product may be processed to any suitable temper. In this regard, the forged product may be solution heat treated (250), optionally quenched and/or artificially aged (260). A recovery anneal may be employed, if appropriate. One particularly useful temper for 7xxx alloys is the T74 temper, as this temper may achieve the strength values noted above, but is corrosion resistant, by definition. For the 2xxx alloys, T6- and T8-type temper are particularly useful. Other significant tempers include the T3, T6, T8, and T9, as well as other T7X type tempers (described below), although other tempers may be applied, based on product requirements, as recognized by those skilled in the art.

T7X Tempers:

T79—Very limited overaging to achieve some improved corrosion resistance with limited reduction in strength as compared to the T6 Temper.

T76—Limited overaged condition to achieve moderate corrosion resistance with some reduction in strength. The T76 temper has lower strength and better corrosion resistance than the T79 temper.

T74—Overaged condition to achieve good corrosion resistance with a greater reduction in strength than the T76 temper. The T74 temper strength and corrosion resistance properties are between those of the T73 and T76 tempers.

T73—Fully overaged condition to achieve the best corrosion resistance of the T7X tempers with a greater reduction in strength than the T74 temper.

T77—Aged condition which provides strength at or near T6 temper and corrosion resistance similar to T76 temper.

The forged products may be die forged or hand forged. The new forged products generally have a sectional thickness of at least about 1 inch. In one embodiment, a new forged product has a sectional thickness of at least about 1.5 inches. In other embodiments, the new forged product may have a sectional thickness of at least about 1.75 inches, or at least about 2 inches, or at least about 2.25 inches, or at least about 2.5 inches, or at least about 2.75 inches, or at least about 3 inches, or at least about 3.25 inches, or at least about 3.5 inches, or at least about 3.75 inches, or at least about 4 inches, or more.

DEFINITIONS

A "crystalline microstructure" is the structure of a polycrystalline material. A crystalline microstructure has crystals, referred to herein as grains. A forged product aluminum alloy product generally has a crystalline microstructure.

"Grains" are crystals of a polycrystalline material.

"First type grains" means those grains of a crystalline microstructure that meet the "first grain criteria", defined below, and as measured using the OIM sampling procedure. Due to the unique microstructure of the product, the present application is not using the traditional terms "recrystallized" or "unrecrystallized", which can be ambiguous and the subject of debate, in certain circumstances. Instead, the microstructure is being defined as "first type grains" and "second type grains", where the amount of these types of grains is accurately and precisely determined by use the of computerized methods detailed in the OIM sampling procedure. Thus, the term "first type grains" includes any grains that meet the first grain criteria, and irrespective of whether those skilled in the art would consider such grains to be unrecrystallized or recrystallized.

The "OIM sample procedure" is as follows: the software used is TexSEM Lab OIM Data Collection Software version 5.31 (EDAX Inc., New Jersey, U.S.A.), which is connected via FIREWIRE (Apple, Inc., California, U.S.A.) to a Digi-View 1612 CCD camera (TSL/EDAX, Utah, U.S.A.). The SEM is a JEOL JSM840A (JEOL Ltd. Tokyo, Japan). OIM run conditions are 70° tilt with a 18 mm working distance and an accelerating voltage of 25 kV with dynamic focusing and spot size of 1 times $10^{-7}$ amp. The mode of collection is a square grid. Only orientations are collected (i.e., Hough peaks information is not collected). The area size per scan is 3.4 mm by 1.1 mm at 3 micron steps at 75×. The collected data is output in an *.osc file. This data may be used to (i) calculate the volume fraction of first type grains, (ii) obtain ODF plots and relative texture intensities, and (iii) obtain pole figures, as described below.

Calculation of volume fraction of first type grains: The volume fraction of first type grains is calculated using the data of the *.osc file and the TexSEM Lab OIM Analysis Software version 5.31. Prior to calculation, data cleanup may be performed with a 15° tolerance angle, a minimum grain size=3 data points, and a single iteration cleanup. Then, the amount of first type grains is calculated by the software using the first grain criteria (below).

First grain criteria: Calculated via grain orientation spread (GOS) with a grain tolerance angle of 5°, minimum grain size is three (3) data points, and confidence index is zero (0). All of "apply partition before calculation", "include edge grains", and "ignore twin boundary definitions" should be required, and the calculation should be completed using "grain average orientation". Any grain whose GOS is ≤3° is a first type grain.

ODF plots: Orientation Distribution Function (ODF) are calculated using TexSEM Lab OIM Analysis Software version 5.31. The obtained data are processed with a single iteration dilation cleanup with a 15° grain tolerance angle and 3 points per grain minimum grain size (27 microns$^2$). The ODF is calculated by Harmonic Series Expansion with a series rank of L=16 and a Gaussian half-width of 5°. Triclinic sample symmetry is selected and all measured points in the partition are included in the calculation. Bunge Euler angles are selected for the ODF calculation with phi1, PHI, and phi2 starting at 0° and ending at 90° with 5° resolution.

Pole Figures: The TexSEM Lab OIM Analysis Software version 5.31 is used to calculate pole figures (e.g., (111) and/or (200)). The pole figures should be calculated with no inversion symmetry and with a resolution of 5°.

"Second type grains" means any grains that are not first type grains.

"First grain volume" means the volume of first type grains of the crystalline material.

"Representative first grains" means those first type grains that are representative of the majority (e.g., from about 60-90 vol. %) of the first grain volume.

"Aspect ratio" means the ratio of a first dimension of an object (e.g., length, L) to a second dimension of an object (e.g., width, W). With respect to grains of a crystalline microstructure, the aspect ratio is generally calculated using the linear intercept method.

"Average aspect ratio" means the average of the aspect ratios of representative grains of a microstructure.

"Longitudinal" (L), "long transverse", (LT), and "short transverse" (ST), have the meaning provided for by FIG. 12.

Strength testing is conducted in accordance with ASTM E8 and B557. Tensile yield strength is at 0.2 offset.

"Comparable composition" means an aluminum alloy composition that is within the standard tolerances provided for by the Aluminum Association (AA). For example, AA alloy 7055 includes 7.6-8.4 wt. % Zn, 2.0-2.6 wt. % Cu, 1.8-2.3 wt. % Mg, up to 0.1 wt. % Si, up 0.15 wt. % Fe, up to 0.05 wt. % Mn, up to 0.04 wt. % Cr, up to 0.06 wt. % Ti, and 0.08-0.25 wt. % Zr, the balance being aluminum and other impurities, with no other impurity exceeding 0.05 wt. % individually, and with the total of all other impurities not exceeding 0.15 wt. %. Any alloys within this composition range are comparable to one another in terms of composition. For properties to be comparable, the products should also be of similar product form, size and dimensions. Difference in measured properties, especially toughness properties, can vary greatly with differing product forms, sizes and/or dimensions.

These and other aspects, advantages, and novel features of this new technology are set forth in part in the description that follows and will become apparent to those skilled in the art upon examination of the following description and figures, or may be learned by practicing one or more embodiments of the technology provided for by the present disclosure.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

FIG. 5*e* contains ODF plots or an extruded 7xxx aluminum alloy product having a low amount of first type grains (linear scale).

DETAILED DESCRIPTION

Reference will now be made in detail to the accompanying drawings, which at least assist in illustrating various pertinent embodiments of the new technology provided for by the present disclosure.

Example 1

Production of Conventionally Forged Aluminum Alloy Product

Figure 1A:
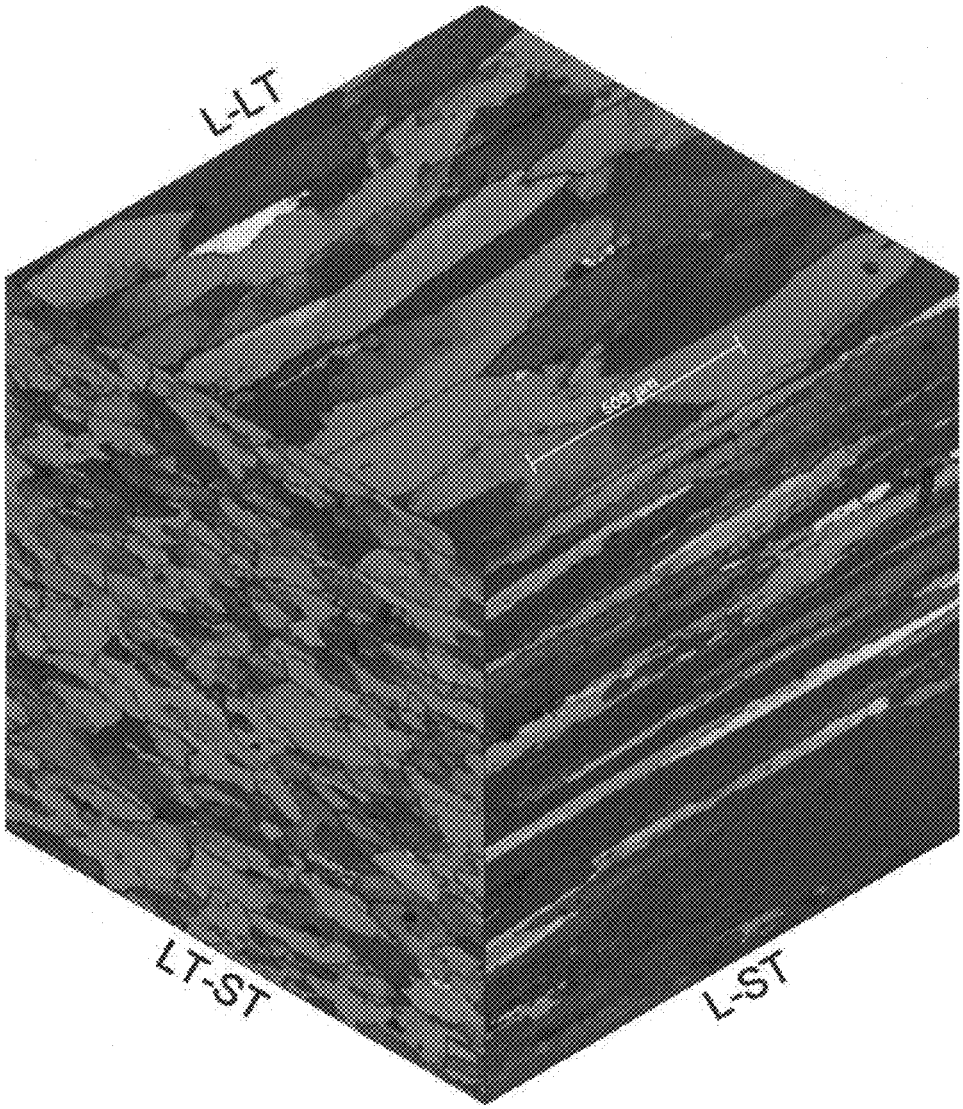
FIG. 1*a* is an optical micrograph (50× magnification) of a conventional forged 7xxx aluminum alloy product.
Figure 1B:
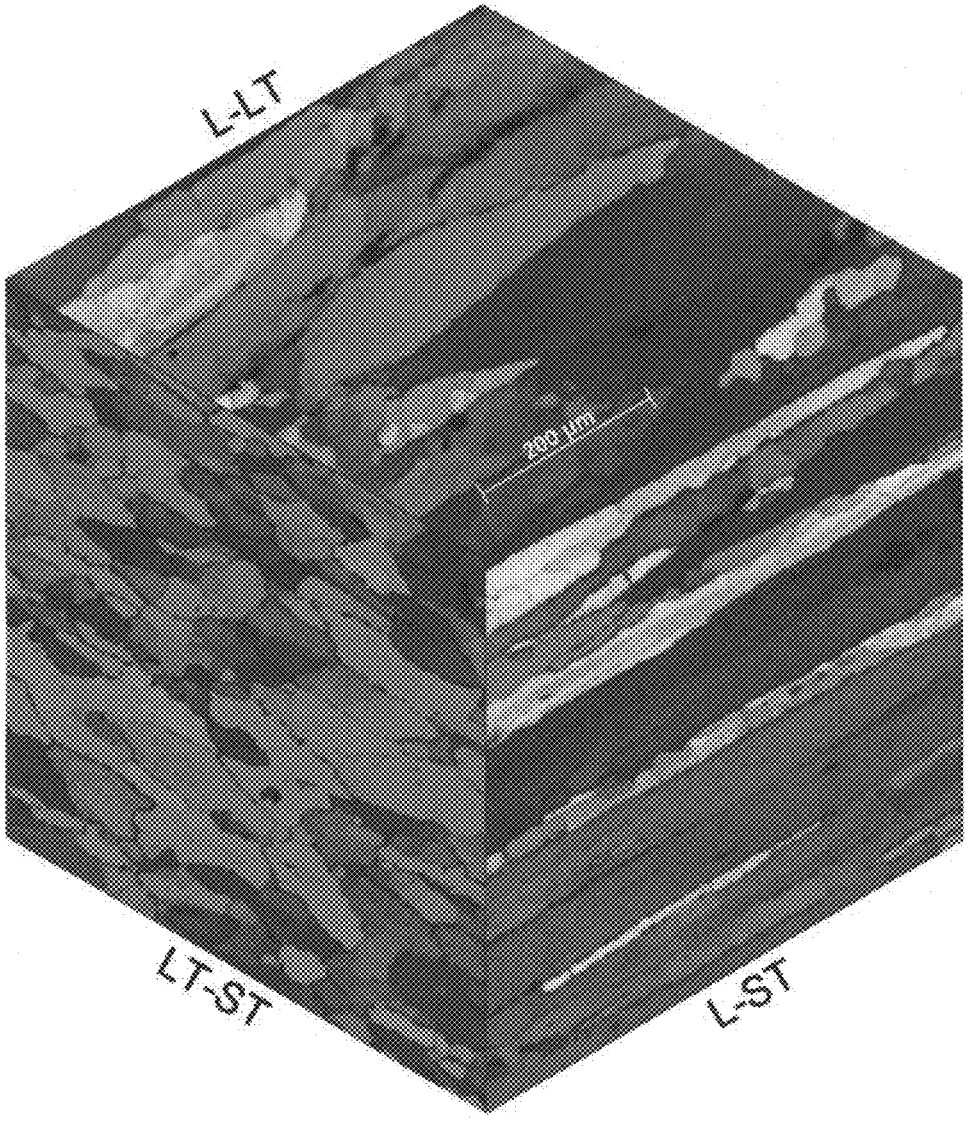
FIG. 1*b* is an optical micrograph (100× magnification) of a conventional forged 7xxx aluminum alloy product.

Aluminum association alloy 7085 is die forged and heat treated to a T74-type temper from ingot stock using conventional forging procedures. Optical micrographs of the 7085 forged product are obtained at the midplane (T/2); samples are anodized (electro-polished) and the images are obtained using cross-polarized light at both 50× and 100× magnification. As illustrated in FIGS. 1*a*-1*b*, the 7085 forged product comprises a mixed microstructure having grains of a first type and a second type. OIM analysis indicates that the 7085 forged product contains about 31.4 vol. % grains of the first grain type. The first grain types ("first grains") are large and equiaxed in the LT-ST plane. The representative first grains of the 7085 forged product have an aspect ratio of about 2.4 in the LT-ST plane using the linear intercept method. The representative first grains of the 7085 forged product have an aspect ratio of about 15.2 in the L-ST plane.

Figure 2:
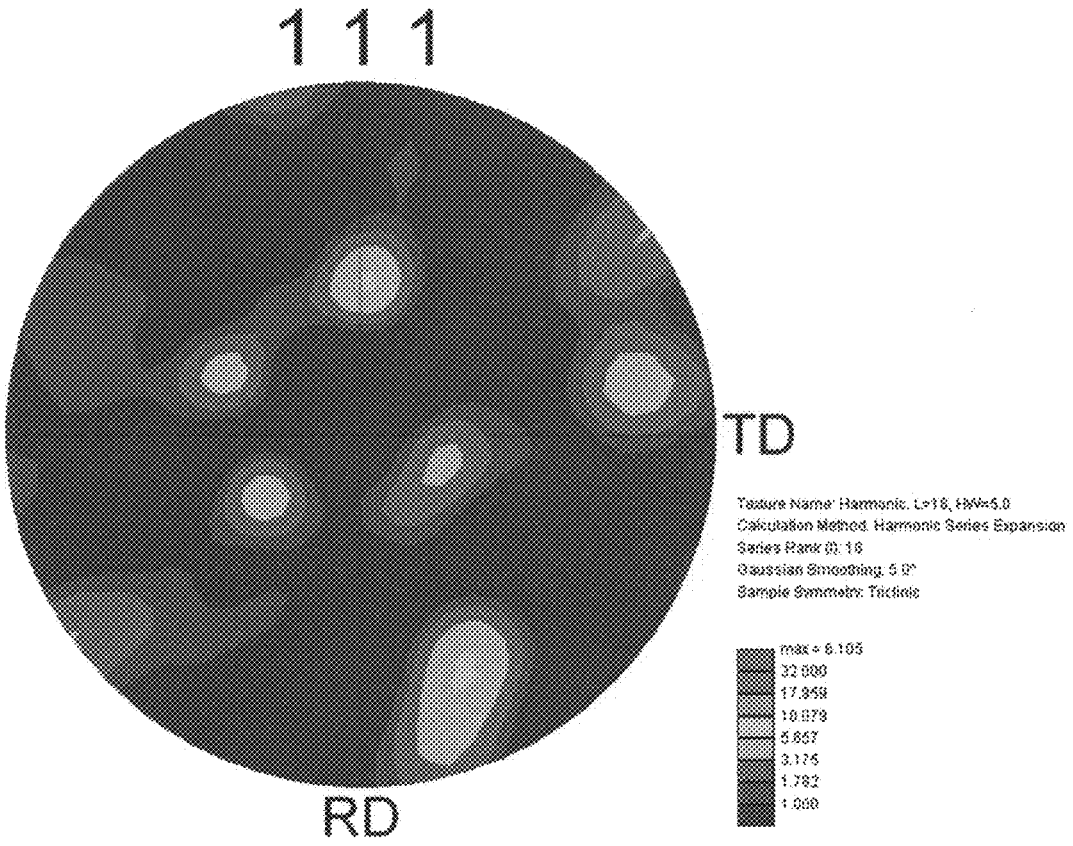
FIG. 2 is the (111) pole figure for a conventional forged product 7xxx aluminum alloy product (log. scale).
Figure 3:
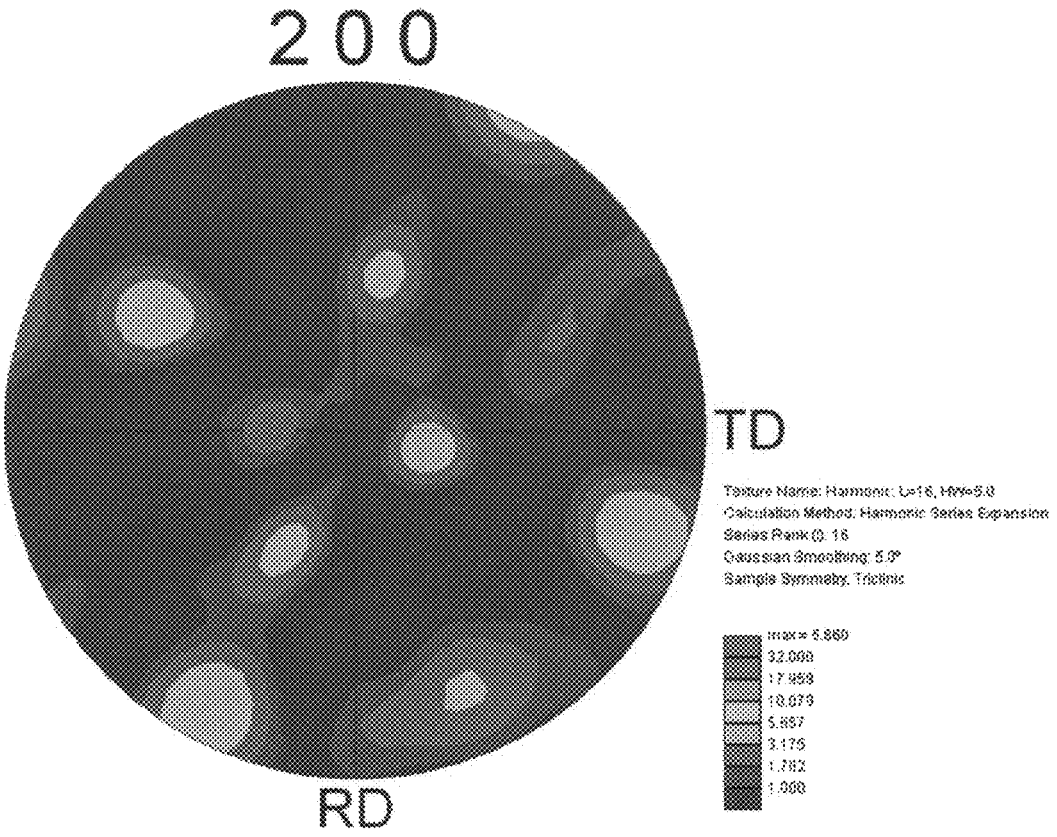
FIG. 3 is the (200) pole figure for a conventional forged product 7xxx aluminum alloy product (log. scale).
Figure 4:
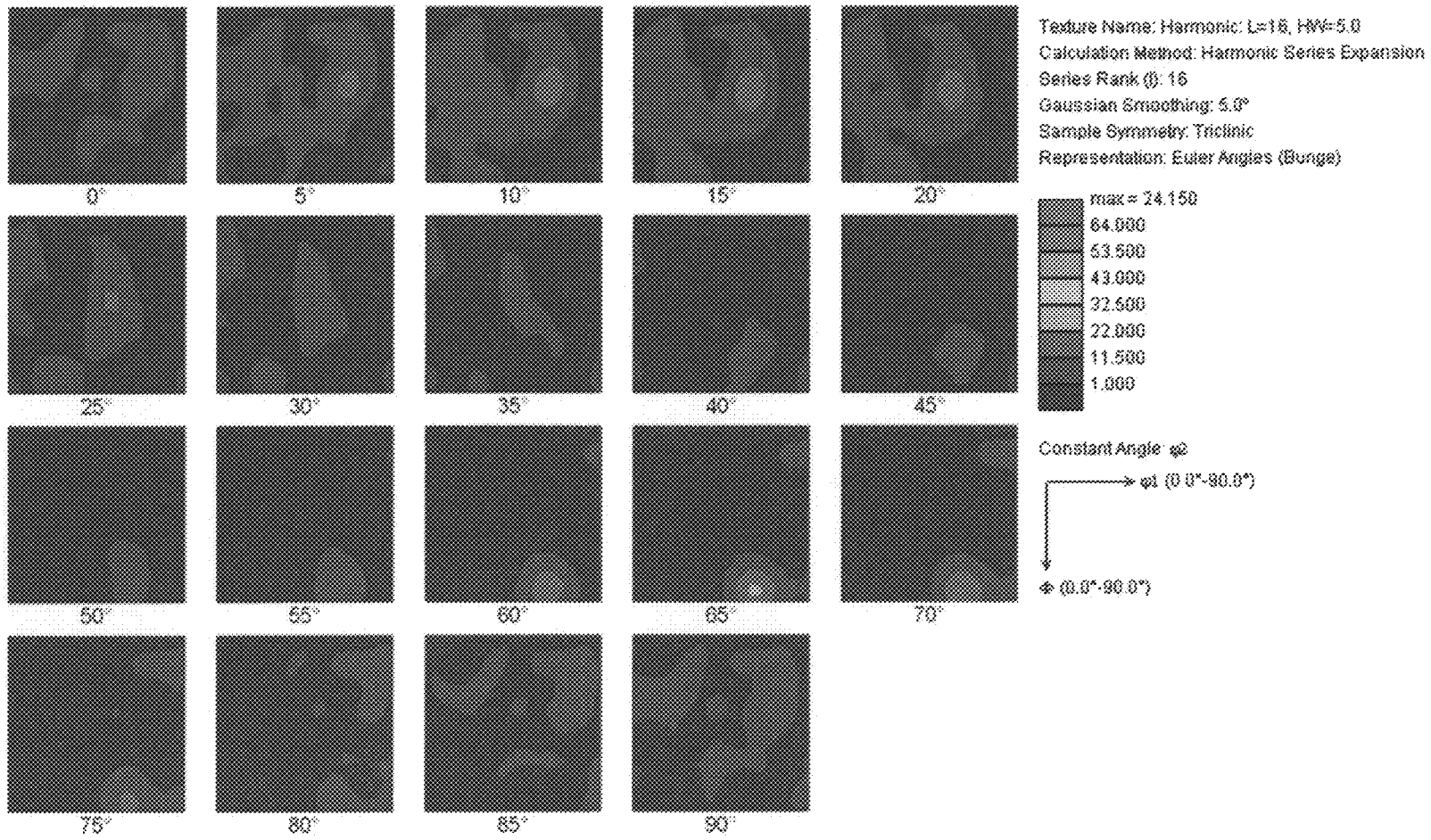
FIG. 4 contains ODF plots for a conventional forged product 7xxx aluminum alloy product (linear scale).

Pole figures in the (111) and (200) planes and ODF plots of the 7085 forged product are also obtained using the OIM sample procedure. Both the (111) and (200) pole figures have relatively low intensity (times random) texture species realizing a maximum intensity of about 6.1 and 5.66 respectively, as illustrated in FIGS. 2-3. The texture is also fairly randomly distributed in each of the pole figures. As illustrated in FIG. 4, the maximum ODF intensity from the ODF plots is 24.15. These results indicate that some texture, but not a significant amount of texture, is present in the 7085 forged product.

These types of 7085 forged products generally realize a strength that is several ksi below the strength of a 7085 extruded product of a similar temper.

Example 2

Production of New Forged Product

Aluminum association alloy 7255 is cast and extruded as rod. The billet used to produce the rod was cast using 30 PPI filters to keep the metal clean, and an inert degassing box to reduce hydrogen levels to about 5 ppm. The billet is extruded via indirect extrusion at an extrusion ratio of about 17.3:1. The extrusion speed averaged about 6.2 feet/minute and the temperature was about 630° F. Induction heating was used in an effort to maintain adiabatic extrusion conditions.

Figure 5A:
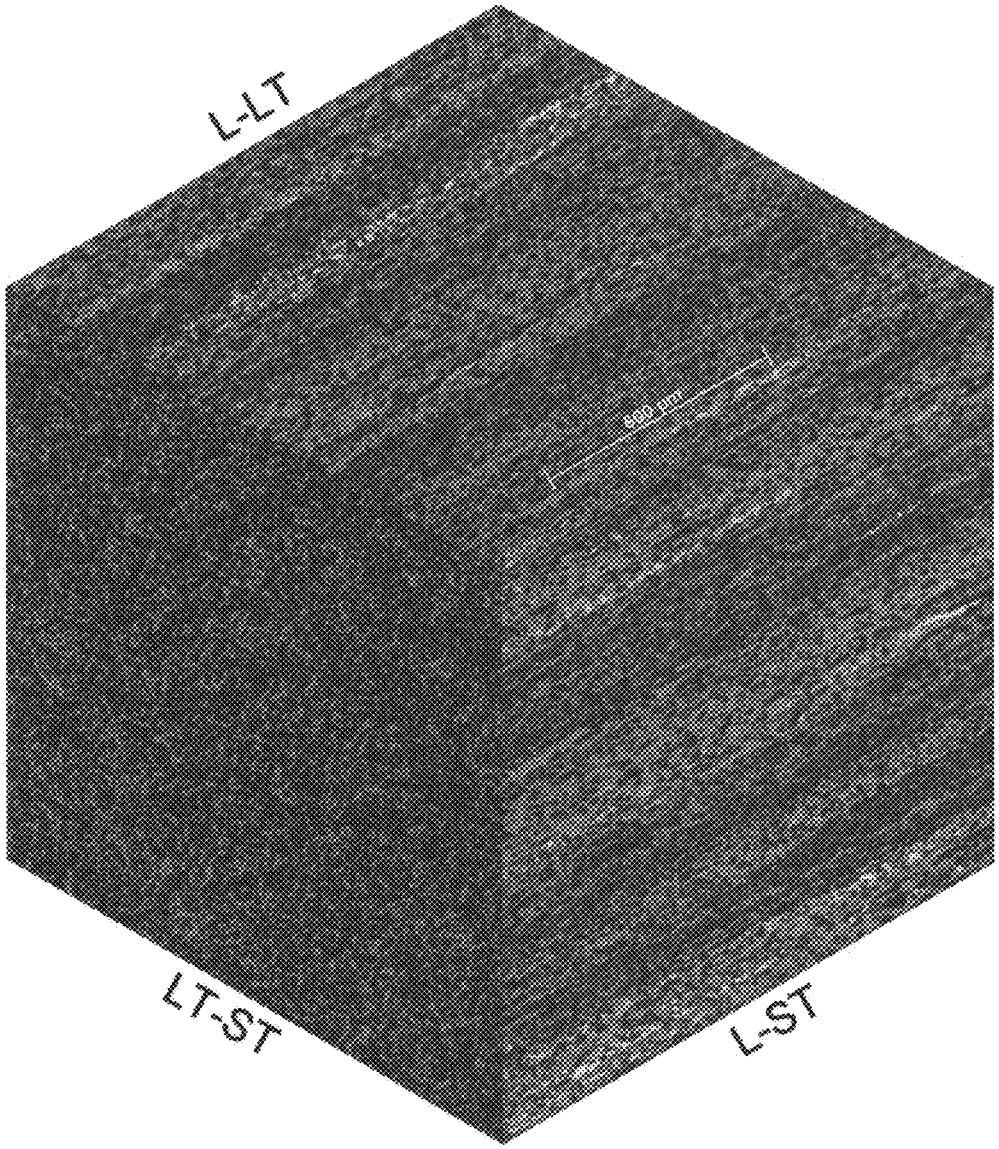
FIG. 5*a* is an optical micrograph (50× magnification) of an extruded 7xxx aluminum alloy product having a low amount of first type grains.
Figure 5B:
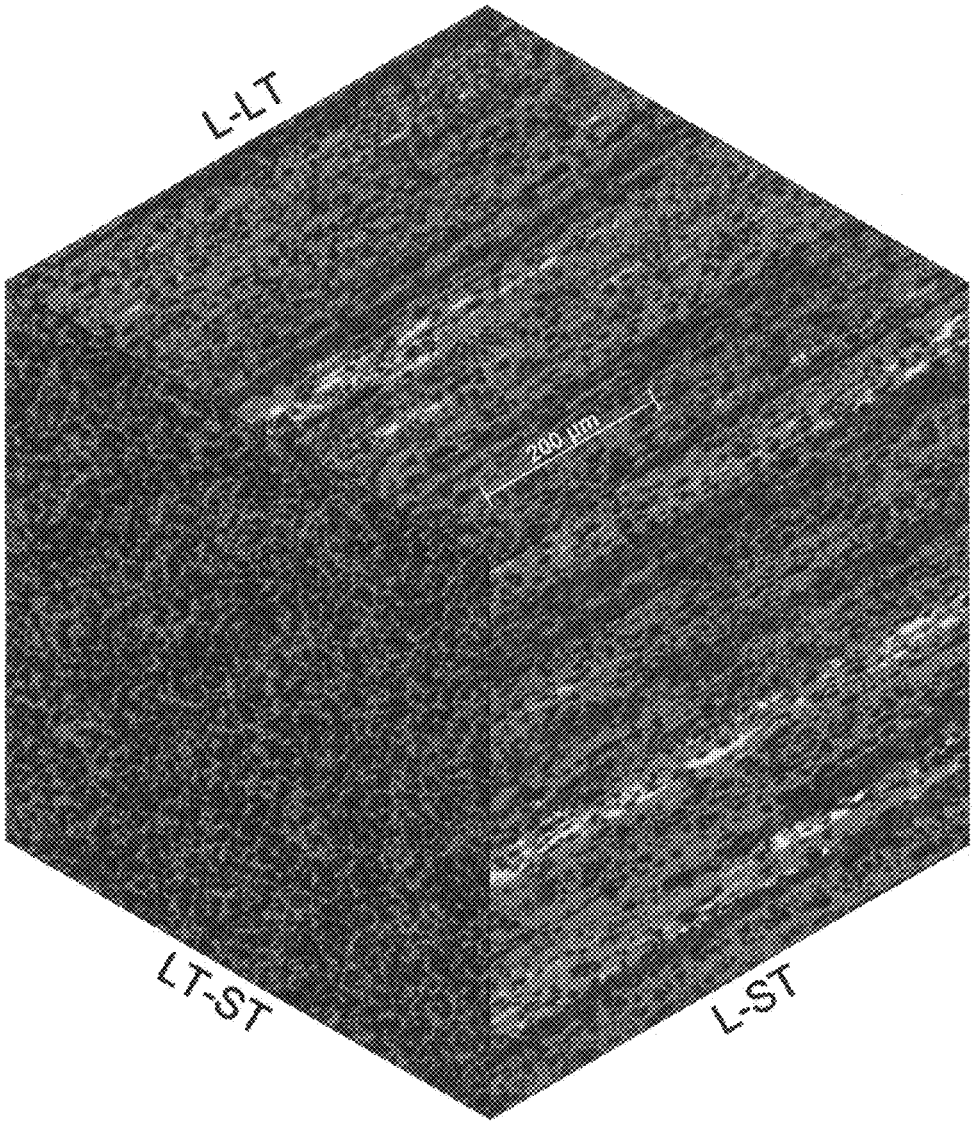
FIG. 5*b* is an optical micrograph (100× magnification) of an extruded 7xxx aluminum alloy product having a low amount of first type grains.

Optical micrographs of the extruded product are obtained at D/2; samples are anodized (electro-polished) and the images are obtained using cross-polarized light at both 50× and 100× magnification. As illustrated in FIGS. 5*a*-5*b*, the 7255 extruded product comprises a mixed microstructure having grains of a first type and a second type. OIM analysis indicates that the 7255 extruded product contains about 17 vol. % grains of the first grain type. Those skilled in the art may consider this microstructure to be completely unrecrystallized, but, as described above, to reduce ambiguity "first grain type" is being used in the patent application.

Figure 5C:
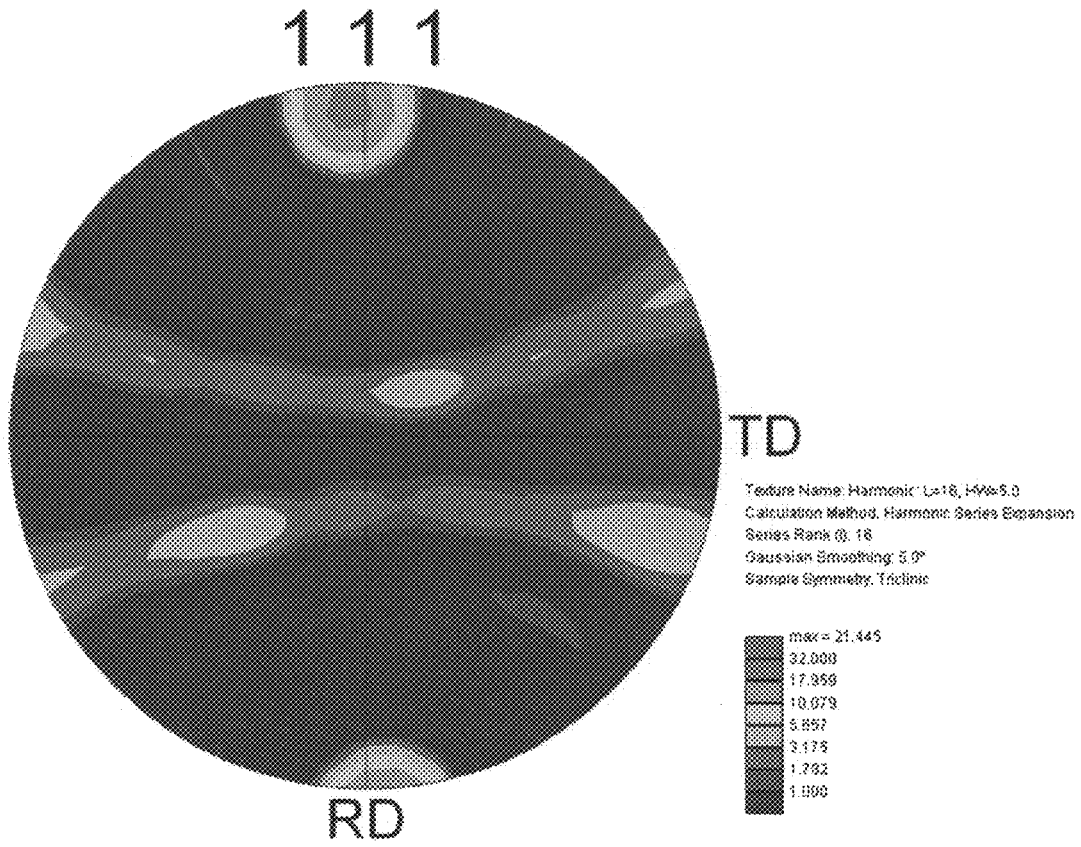
FIG. 5*c* is the (111) pole figure for an extruded 7xxx aluminum alloy product having a low amount of first type grains (log. scale).
Figure 5D:
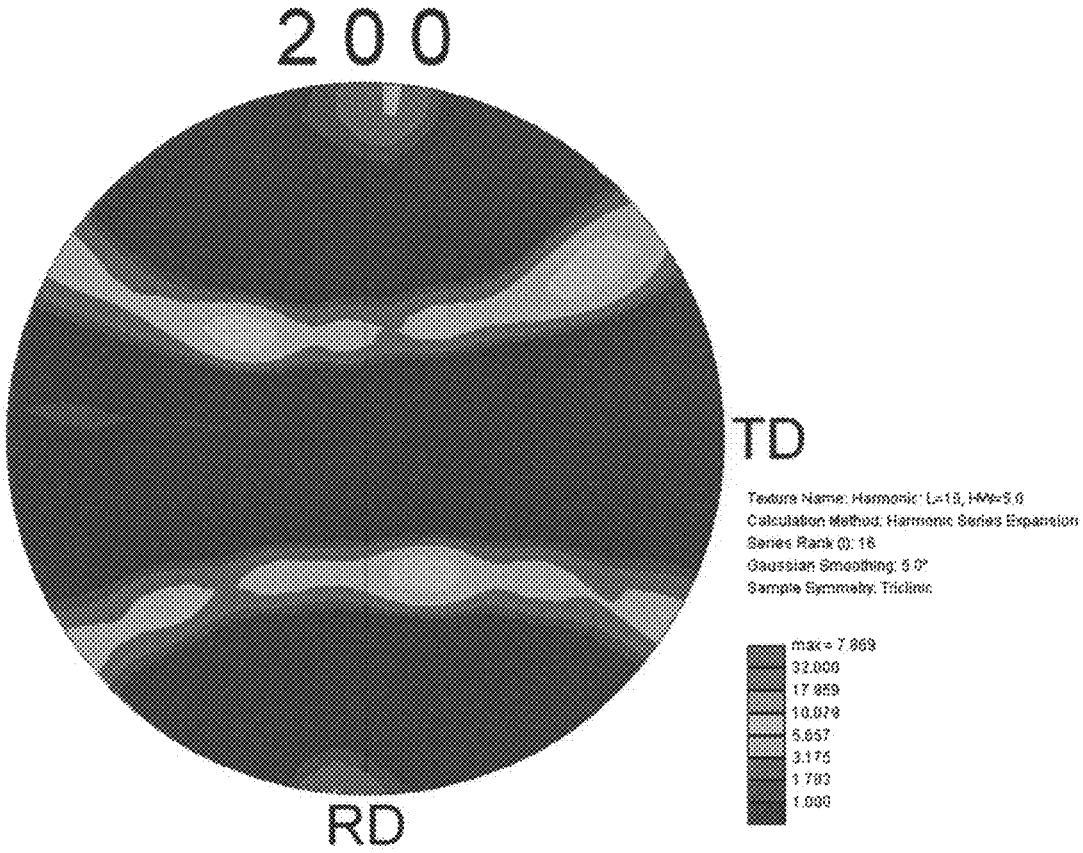
FIG. 5*d* is the (200) pole figure for an extruded 7xxx aluminum alloy product having a low amount of first type grains (log. scale).
Figure 5A:
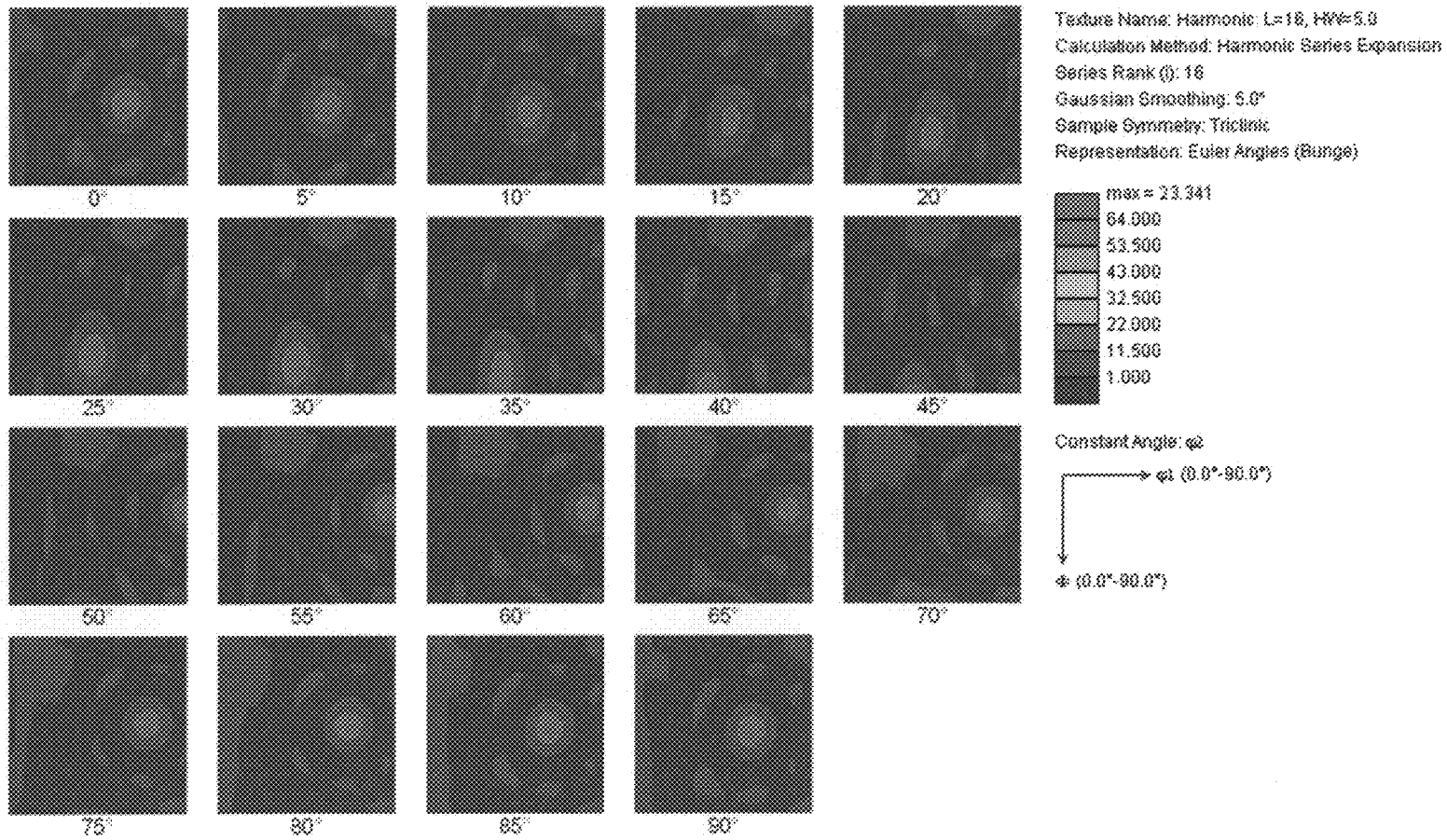

Pole figures in the (111) and (200) planes and ODF plots of the 7255 extruded rod are also obtained using the OIM sample procedure. Both the (111) and (200) pole figures have a good amount of texture (times random) and realize a maximum intensity of about 21.5 and 7.9 respectively, as illustrated in FIGS. 5*c*-5*d*. The higher intensity texture is generally symmetrical in each of the pole figures. As illustrated in FIG. 5*e*, the maximum ODF intensity from the ODF plots is about 23.3. The results indicate that some texture, but not a significant amount of texture, is present in the extruded product.

The 7255 extruded stock is die forged into two forged products in the T74 temper; one a 4-inch blade and the other a 2.9-inch blade. The die forging process takes two steps. The extruded product is first preheated to about 820°+/−20° F., after which it is squeezed into an intermediate shape at about 30 inches per minute, with a die tool temperature of at least about 650° F. The product is then cooled, preheated and squeezed into a final shape at the same conditions. The final product is solution heat treated, quenched, and artificially aged to a T74 temper.

Figure 6A:
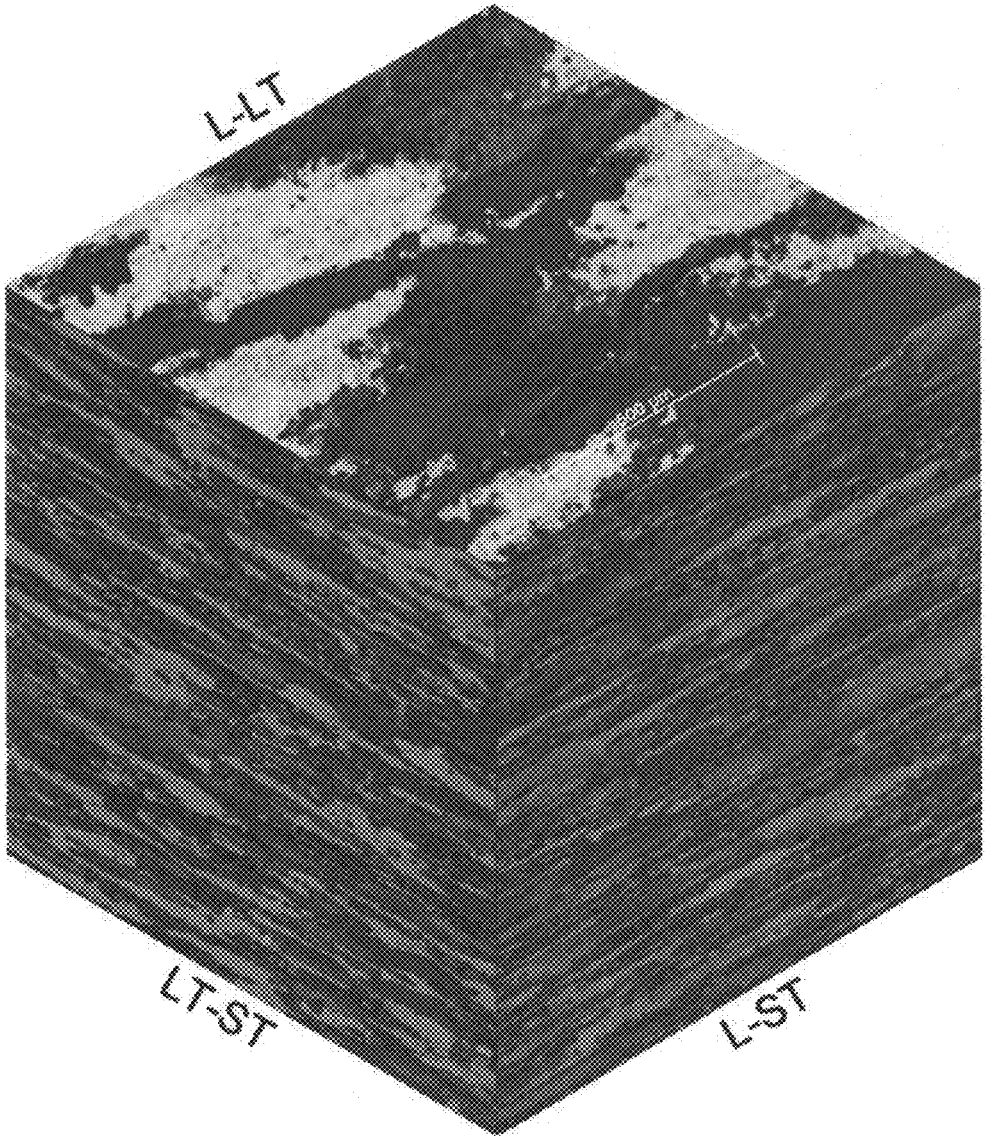
FIG. 6*a* is an optical micrograph (50× magnification) of a new forged 7xxx aluminum alloy product at 50× magnification.
Figure 6B:
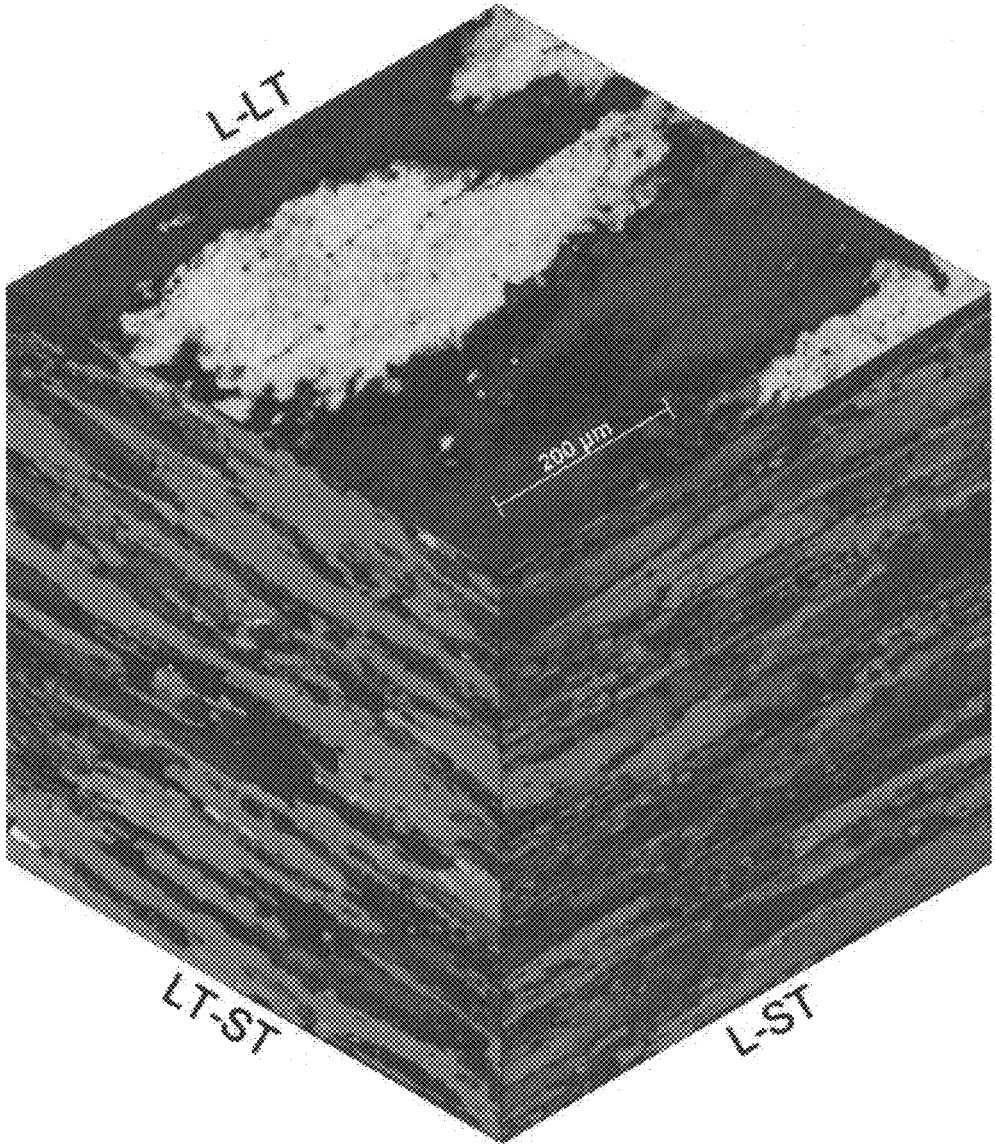
FIG. 6*b* is an optical micrograph (100× magnification) of a new forged 7xxx aluminum alloy product.
Figure 7:
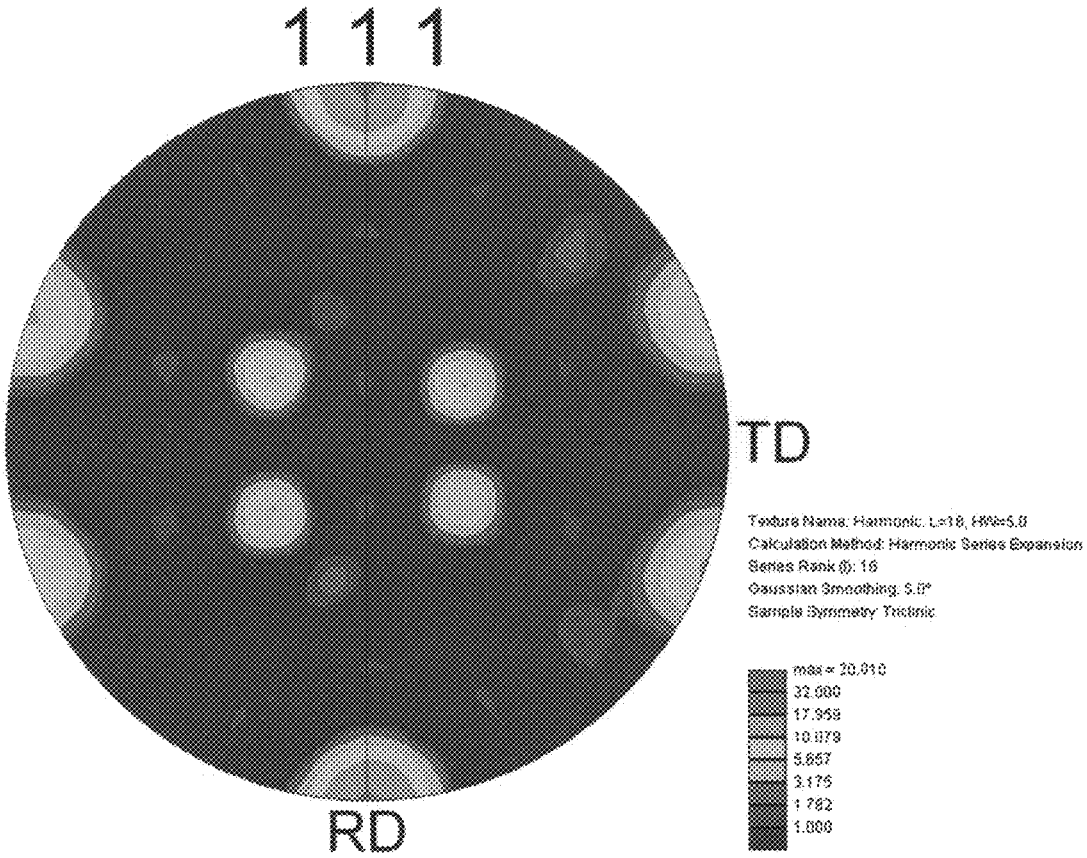
FIG. 7 is the (111) pole figure for a new forged product 7xxx aluminum alloy product.
Figure 8:
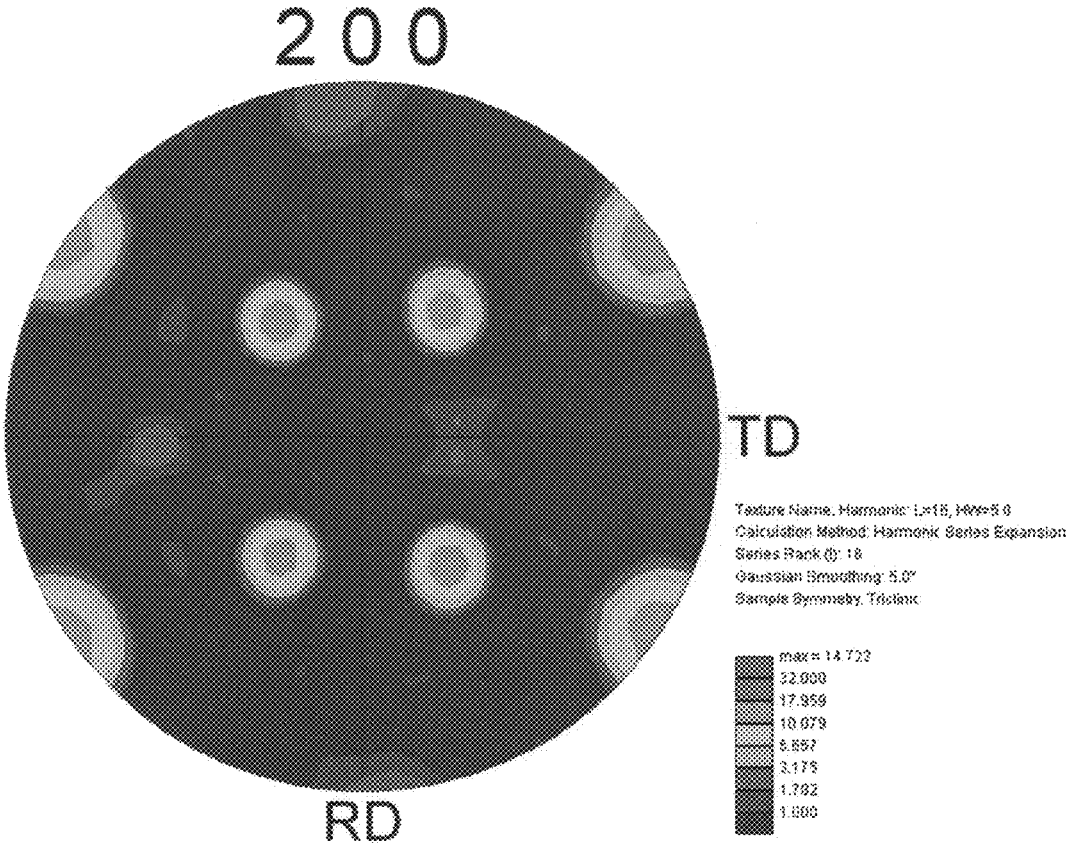
FIG. 8 is the (200) pole figure for a new forged product 7xxx aluminum alloy product.
Figure 9:
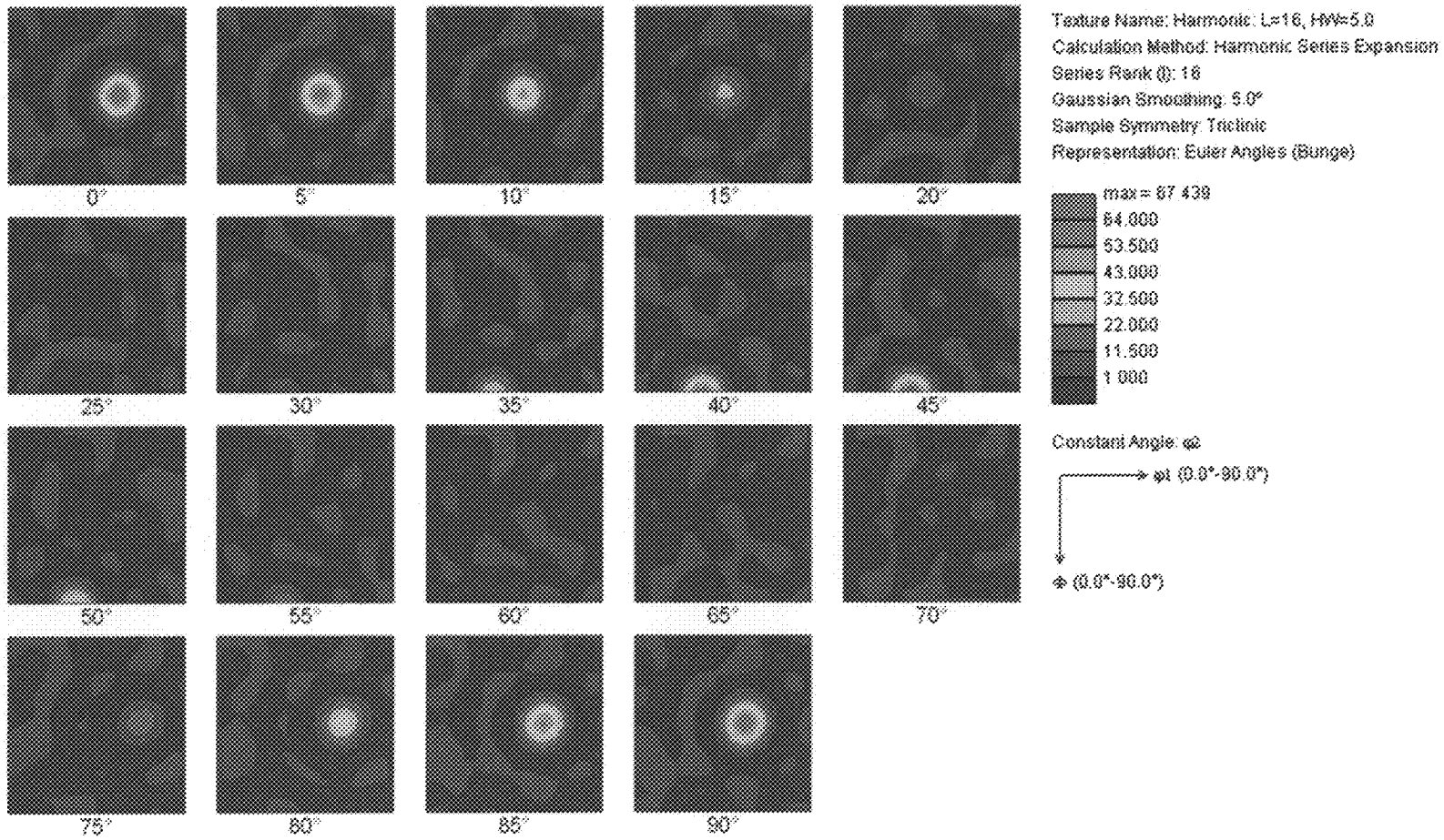
FIG. 9 contains ODF plots for a new forged product 7xxx aluminum alloy product.
Figure 10:
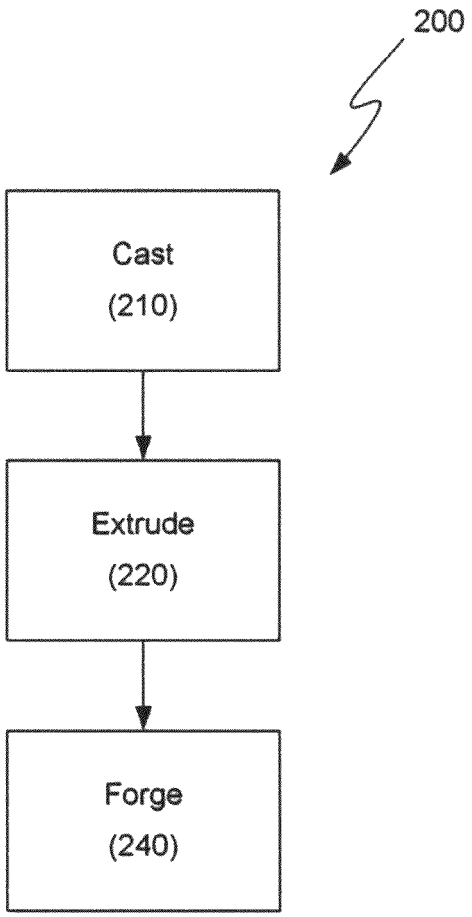
FIG. 10 is a flow chart relating to methods of producing forged products in accordance with the present disclosure.
Figure 11A:
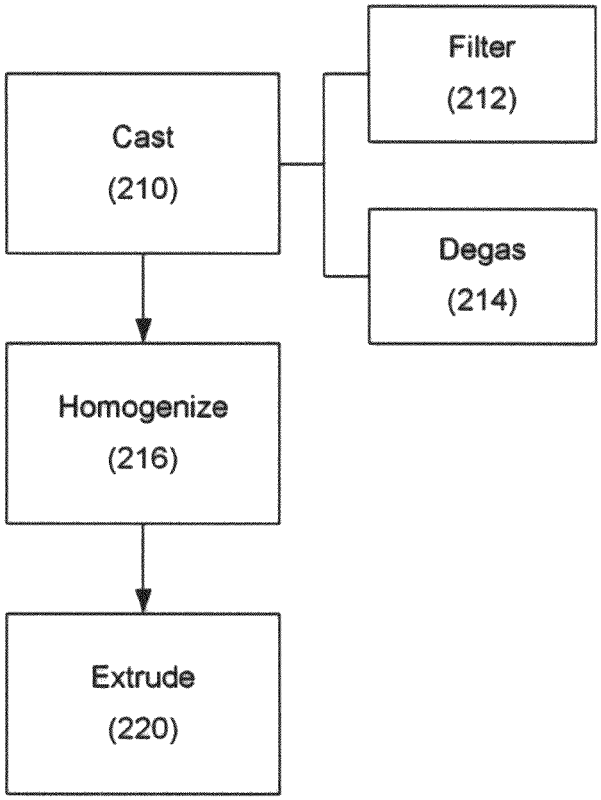
FIG. 11*a* is a flow chart relating to the methods of FIG. 10.
Figure 11B:
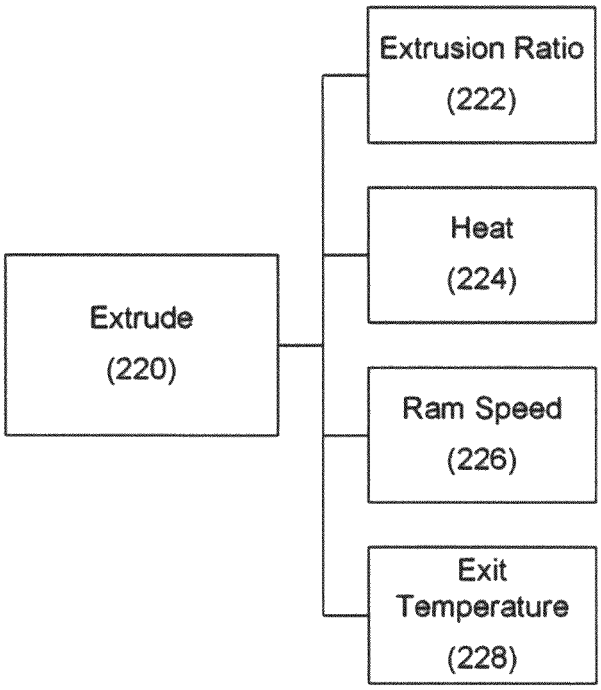
FIG. 11*b* is a flow chart relating to the methods of FIG. 10.
Figure 11C:
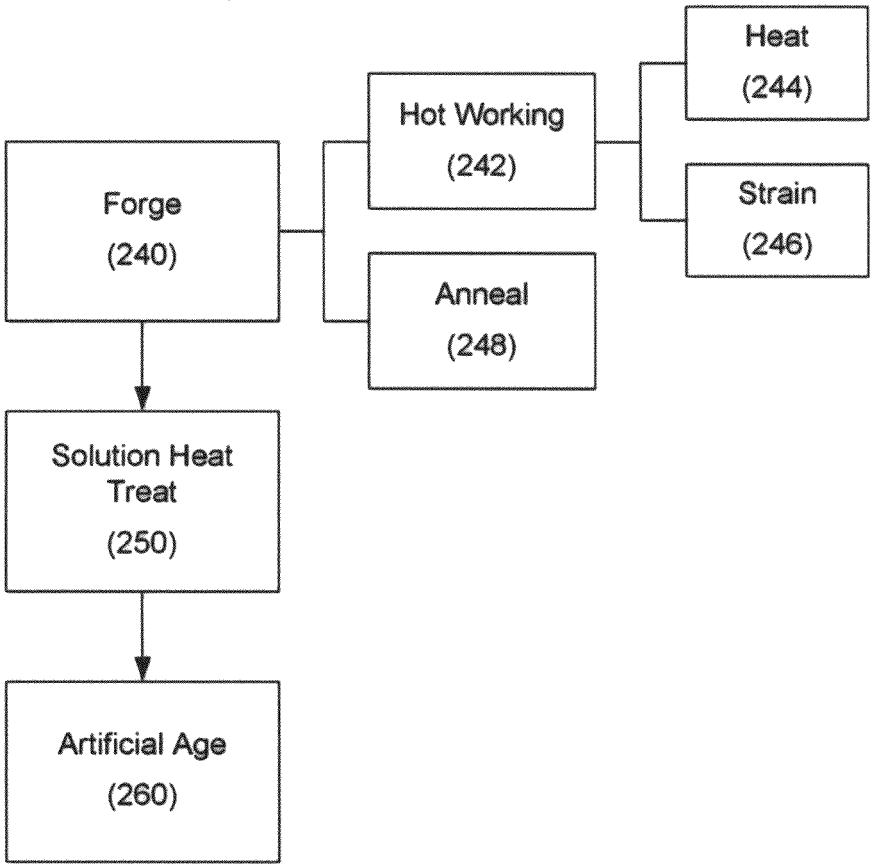
FIG. 11*c* is a flow chart relating to the methods of FIG. 10.
Figure 12:
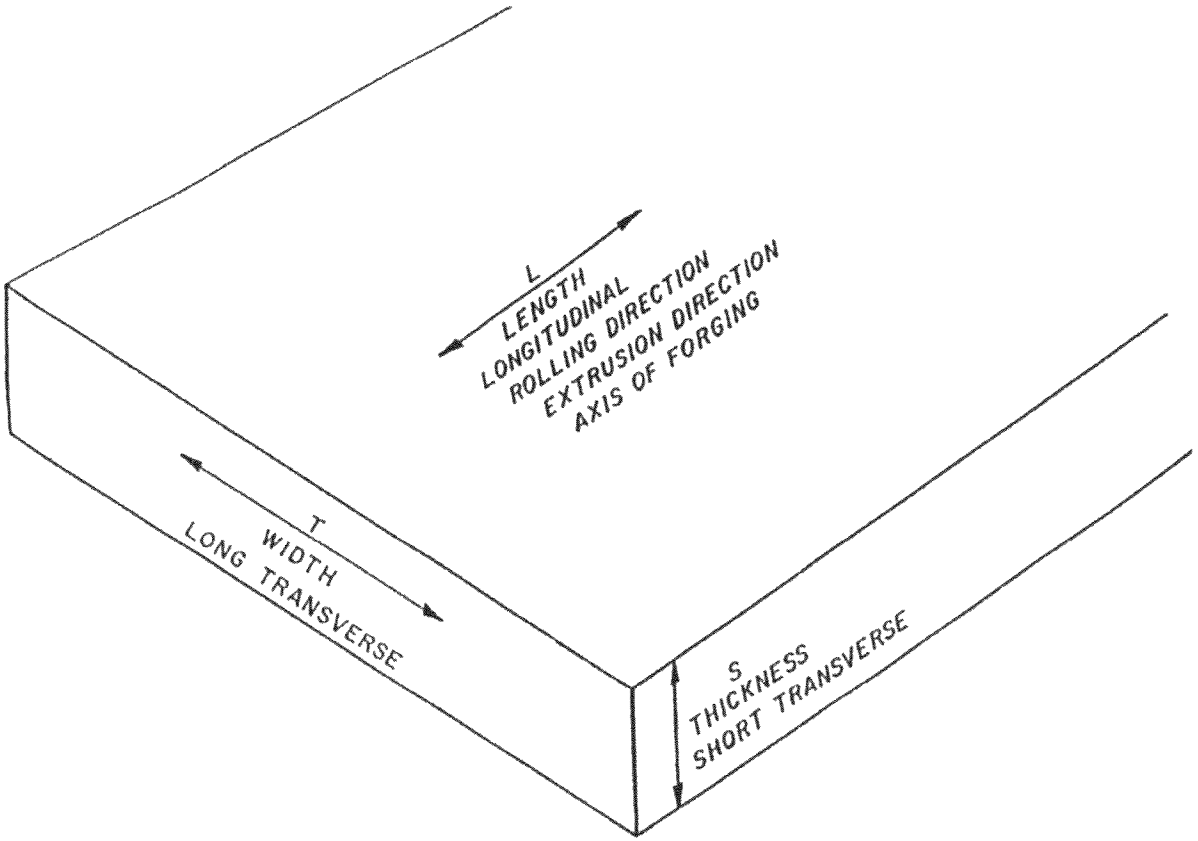
FIG. 12 is a schematic view of a product showing the L, LT and ST directions/dimensions.

Optical micrographs of the 4" 7255 forged product are obtained at the midplane (T/2); samples are anodized (electro-polished) and the images are obtained using cross-polarized light at both 50× and 100× magnification. As illustrated in FIGS. 6*a*-6*b*, the 4" 7255 extruded product comprises a mixed microstructure having grains of a first type and a second type. OIM analysis indicates that the 7255 forged products contain about 25-32 vol. % grains of the first grain type at the T/2 location, an increase of only 8-15% relative to the extruded product. The first grain types ("first grains") have a small aspect ratio in both the L-ST and LT-ST planes. The representative first grains of the 4" 7255 extruded product have an aspect ratio of about 5.7 in the LT-ST plane using the linear intercept method. The representative first grains of the 7255 extruded product have an aspect ratio of about 9.1-1 in the L-ST plane. Similar results are realized with the 2.9" 7255 forged product.

Pole figures in the (111) and (200) planes and ODF plots of the 4" 7255 forged product are also obtained using the OIM sample procedure. Both the (111) and (200) pole figures have relatively high intensity (times random) texture species in both poles, realizing a maximum intensity of about 20.0 and 14.7, respectively. Notably, the high intensity portions are generally symmetrical to one another in the pole figures, indicating that a high degree of texture exists in the 4" 7255 forged product. Also, the (200) pole figure realizes a much higher maximum intensity than that of its predecessor extruded product. Further evidencing the high amount of texture, the maximum ODF intensity from the ODF plots is about 67.44, which is 41.2 units higher than that of the extruded product, and a 290% increase over the extruded product. This indicates that the degree of texture increased significantly from the extruded product to the forged product. Similar results are realized with the 2.9" 7255 forged product.

Both the 4" and 2.9" 7255 forged products realize high strength. As illustrated in Table 2, below, the new 7255 forged products realize an average tensile yield strength in the L direction that is about 12.2 ksi higher than the typical values for conventionally forged 7055-T74 products, which equates to about an 18% increase in strength. The new 7255 products also realize an average tensile yield strength in the LT direction that is about 5.8 ksi higher than the typical values for conventionally forged 7055-T74 products, which equates to about an 8% increase in strength.

TABLE 2

Typical strength properties of conventional versus new forged 7 × 55 products

| Strength (ksi) | Conventional 7055-T74 Forgings (typ.) | New forged alloys (typical) | Percent Increase |
|---|---|---|---|
| TYS L | 68 | 80.2 | 17.94% |
| UTS L | 76 | 86.3 | 13.55% |
| TYS LT | 72 | 77.8 | 8.06% |
| UTS LT | 79 | 84.2 | 6.58% |

It is postulated that the increase in strength may be due to the controlled extrusion and forging conditions, which create a microstructure having a low amount of first type grains. Additionally, these first type grains have a high aspect ratio in both the L-ST and the LT-ST planes, which may contribute to the high strength. The grains (both first and second type grains) are also highly aligned as evidenced by the pole figures and ODF plots, which may contribute to the high strength.

Although the above examples were completed relative to 7xxx series alloys, it is expected that these principles will apply equally to other aluminum alloys, especially heat treatable alloys, as described above. Furthermore, while various embodiments of the present technology have been described in detail, it is apparent that modifications and adaptations of those embodiments will occur to those skilled in the art. However, it is to be expressly understood that such modifications and adaptations are within the spirit and scope of the present disclosure.

What is claimed is:

1. A forged product, wherein the forged product comprises a 7xxx aluminum alloy, wherein the forged product comprises a crystalline microstructure having grains, wherein the grains include first type grains and second type grains, wherein the crystalline microstructure comprises from 5 vol. % to 50 vol. % of the first type grains, wherein the first type grains include representative first grains;

wherein the representative first grains make up 60-90 vol. % of the first type grains;

wherein the representative first grains have an average aspect ratio of from 5:1 to 20:1 in the LT-ST plane;

wherein the representative first grains have an average aspect ratio of from 6:1 to 30:1 in the L-ST plane;

wherein at least portions of the forged product have a sectional thickness of at least 1 inch; and wherein the forged product realizes a longitudinal tensile yield strength of at least 72 ksi.

2. The forged product of claim 1, wherein the product has a maximum ODF intensity of at least 60.

3. The forged product of claim 1, wherein the representative first grains have an average aspect ratio of at least 9:1 in the L-ST plane.

4. The forged product of claim 1, wherein the forged product consists of a 7x55 aluminum alloy.

5. The forged product of claim 1, wherein the forged product realizes a longitudinal tensile yield strength of at least 74 ksi.

6. The forged product of claim 1, wherein the forged product realizes a longitudinal tensile yield strength of at least 78 ksi.

7. The forged product of claim 1, wherein the forged product realizes a longitudinal tensile yield strength of at least 80 ksi.

8. The forged product of claim 1, wherein the forged product realizes a longitudinal tensile yield strength of at least 82 ksi.

9. The forged product of claim 1, wherein the forged product realizes a longitudinal tensile yield strength of at least 84 ksi.

10. The forged product of claim 1, wherein the forged product realizes a longitudinal tensile yield strength of at least 86 ksi.

11. The forged product of claim 1, wherein the forged product realizes a longitudinal tensile yield strength of at least 88 ksi.

12. The forged product of claim 1, wherein the forged product realizes a longitudinal tensile yield strength of at least 90 ksi.

13. The forged product of claim 5, wherein the forged product realizes a long transverse (LT) tensile yield strength of at least 76 ksi.

14. The forged product of claim 6, wherein the forged product realizes a long transverse (LT) tensile yield strength of at least 78 ksi.

15. The forged product of claim 7, wherein the forged product realizes a long transverse (LT) tensile yield strength of at least 80 ksi.

16. The forged product of claim 8, wherein the forged product realizes a long transverse (LT) tensile yield strength of at least 82 ksi.

17. The forged product of claim 9, wherein the forged product realizes a long transverse (LT) tensile yield strength of at least 84 ksi.

18. The forged product of claim 10, wherein the forged product realizes a long transverse (LT) tensile yield strength of at least 86 ksi.

19. The forged product of claim 11, wherein the forged product realizes a long transverse (LT) tensile yield strength of at least 88 ksi.

20. The forged product of claim 19, wherein the strength properties are realized at a sectional thickness of at least 1 inch of the forged product.

21. The forged product of claim 17, wherein at least portions of the forged product have a sectional thickness of at least 2 inches, and wherein the strength properties are realized at the sectional thickness of at least 2 inches of the forged product.

22. The forged product of claim 15, wherein at least portions of the forged product have a sectional thickness of at least 3 inches, and wherein the strength properties are realized at the sectional thickness of at least 3 inches of the forged product.

23. The forged product of claim 13, wherein at least portions of the forged product have a sectional thickness of at least 4 inches, and wherein the strength properties are realized at the sectional thickness of at least 4 inches of the forged product.

* * * * *